US010029133B2

(12) United States Patent
Miller et al.

(10) Patent No.: US 10,029,133 B2
(45) Date of Patent: Jul. 24, 2018

(54) TRAMPOLINE

(71) Applicant: BOARD & BATTEN INTERNATIONAL INC., Georgetown (KY)

(72) Inventors: David Jethro Miller, Christchurch (NZ); Keith Vivian Alexander, Christchurch (NZ)

(73) Assignee: BOARD & BATTEN INTERNATIONAL, INC., Georgetown (KY)

( * ) Notice: Subject to any disclaimer, the term of this patent is extended or adjusted under 35 U.S.C. 154(b) by 0 days.

(21) Appl. No.: 15/453,159

(22) Filed: Mar. 8, 2017

(65) Prior Publication Data

US 2017/0173376 A1 Jun. 22, 2017

Related U.S. Application Data

(63) Continuation of application No. 13/823,988, filed as application No. PCT/NZ2012/000101 on Jun. 15, 2012.

(60) Provisional application No. 61/579,717, filed on Dec. 23, 2011, provisional application No. 61/510,369, filed on Jul. 21, 2011, provisional application No. 61/497,600, filed on Jun. 16, 2011.

(51) Int. Cl.

| | |
|---|---|
| ***A63B 5/11*** | (2006.01) |
| ***A63B 21/02*** | (2006.01) |
| ***A63B 71/02*** | (2006.01) |

(52) U.S. Cl.

CPC ..... *A63B 5/11* (2013.01); *A63B 21/026* (2013.01); *A63B 71/022* (2013.01)

(58) Field of Classification Search

CPC .. A63B 5/00; A63B 5/11; A63B 21/02; A63B 21/00; A63B 21/023; A63B 21/026

USPC ..... 482/23, 27–32, 121–123, 127–129

See application file for complete search history.

(56) References Cited

U.S. PATENT DOCUMENTS

| | | | | | |
|---|---|---|---|---|---|
| 6,132,338 | A * | 10/2000 | Shifferaw | A63B 5/08 | 482/30 |
| 6,319,174 | B1 * | 11/2001 | Alexander | A63B 5/11 | 482/27 |
| 6,663,538 | B2 * | 12/2003 | Yoon | A63B 5/11 | 482/27 |
| 7,611,443 | B2 * | 11/2009 | Publicover | A63B 5/11 | 482/27 |
| 7,678,024 | B2 * | 3/2010 | Alexander | A63B 5/11 | 482/27 |
| 7,708,667 | B2 * | 5/2010 | Alexander | A63B 5/11 | 482/27 |
| 7,854,687 | B2 * | 12/2010 | Alexander | A63B 5/11 | 482/27 |
| 8,303,469 | B2 * | 11/2012 | Alexander | A63B 5/11 | 482/27 |
| D684,233 | S * | 6/2013 | Yang | D21/797 | |

(Continued)

*Primary Examiner* — Garrett Atkinson

(74) *Attorney, Agent, or Firm* — Dann, Dorfman, Herrell and Skillman, P.C.

(57) ABSTRACT

A trampoline comprises a mat, a frame, and a plurality of support rods connecting between the frame and the mat to hold the mat in tension above the frame, the support rods extending or bowing outwards from the frame and curving upwards from the frame towards the mat. Each of the support rods may have an associated shorter secondary support rod. The support rods may have a rectangular cross-section.

29 Claims, 19 Drawing Sheets

(56) References Cited

U.S. PATENT DOCUMENTS

| | | | | |
|---|---|---|---|---|
| 2002/0098948 | A1* | 7/2002 | Yoon | A63B 5/11 482/27 |
| 2007/0012902 | A1* | 1/2007 | Mo | A63B 71/0054 256/24 |
| 2013/0210590 | A1* | 8/2013 | Publicover | A63B 5/11 482/110 |
| 2014/0066259 | A1* | 3/2014 | Andon | A63B 5/11 482/27 |

* cited by examiner

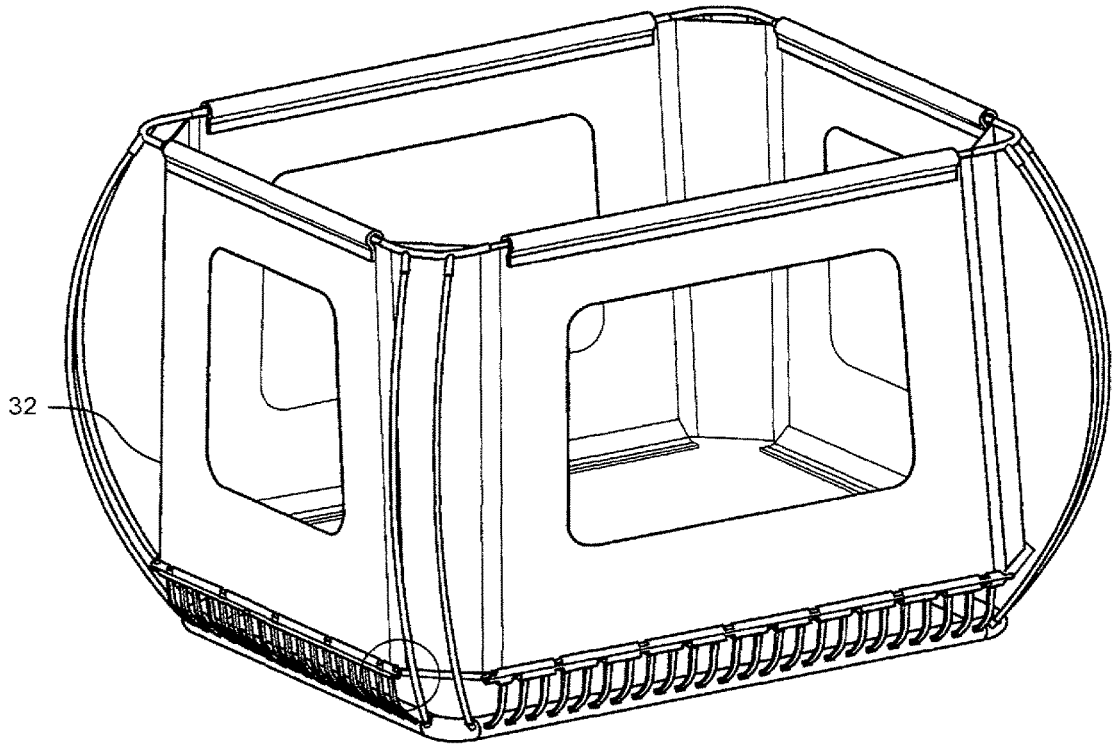
FIGURE 7A
FIGURE 7B
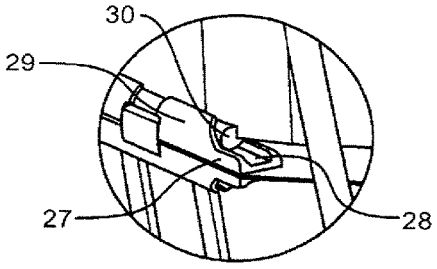

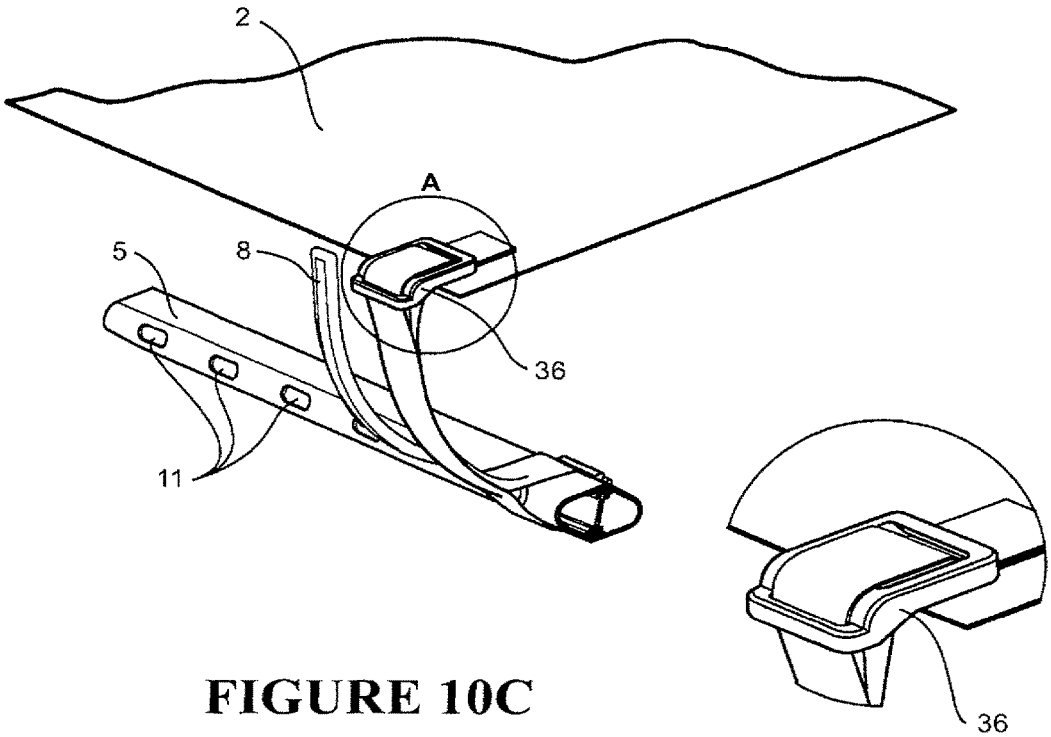
FIGURE 10C
FIGURE 10D
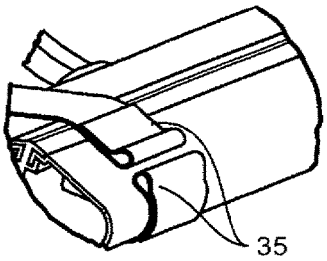

TRAMPOLINE

FIELD OF THE INVENTION

The invention relates to a trampoline.

BACKGROUND OF THE INVENTION

A trampoline generally comprises a rebounding mat fixed to a support frame supported above the ground. A user jumps or bounces on the mat. Usually, trampolines are equipped with a safety enclosure, which extends upwards from the mat to surround or enclose the mat to prevent a user from falling from the trampoline Typically the safety enclosure is formed from mesh or netting and is supported in position by poles which extend upwards from around the edge of the trampoline. Usually these poles are connected to the frame.

A conventional trampoline incorporates a peripheral metal frame with the mat tensioned within frame by extension springs spaced about the edge of the mat and extending outwards from the mat to the frame. An example of this type of trampoline design is shown in FIG. 1*b*. The trampoline may have a safety enclosure held in position by a number of enclosure support members.

U.S. Pat. No. 6,319,174 discloses a form of soft-edged trampoline in which the mat of the trampoline is supported by a plurality of resiliently flexible rods received in a frame of the trampoline at the lower ends of the rods, the upper end of the rods coupled to the periphery of the bouncing or rebounding mat of the trampoline, this arrangement avoiding the need for a solid frame about the exterior of the bouncing mat, and exposed springs between the frame and periphery of the mat. The rods are angled or spiralled around the frame, extending outwards and upwards from the frame. An example of this type of arrangement is shown in FIG. 1*a*. Again the trampoline may have a safety enclosure held in position by a number of enclosure support members.

U.S. Pat. Nos. 6,053,845 and 7,854,687 disclose enclosures similar to those shown in FIGS. 1*a* and 1*b*.

U.S. Pat. No. 6,663,538 discloses a trampoline in which the mat is supported by a series of plane springs formed from a material such as steel, the plane springs having the shape of pre-curved flat bars, the lower part of the bars forming a base for the trampoline. The bars are formed to have a 'Z'-shape or a recurved shape, bending outwards, then inwards, and then outwards again before connecting to the edge of the mat.

SUMMARY OF THE INVENTION

It is an object of the invention to provide an improved or at least an alternative form of trampoline.

In a first aspect the invention may broadly be said to consist in a trampoline system comprising:

a flexible rebounding mat, a plurality of support rods, a frame, the support rods connecting between the frame and the mat to hold the mat in tension and aligned in a substantially horizontal plane above the frame, the upper ends of the rods connected to the mat around the periphery of the mat, the lower ends connected to the frame, the free length of the rods between the upper ends and the lower ends rods extending or bowing outwards from the frame along the entire free length, the rods curving upwards from the frame towards the mat, the rods aligned to extend outwards substantially perpendicular to the frame.

Preferably the rods are flat when no external force is applied.

Preferably the rods have a square or rectangular cross-section.

Preferably the rods are formed from fibreglass.

Preferably the frame has the overall form of a rectangle in plan view, the mat rectangular and having a perimeter which overlaps with the frame.

Preferably each of the support rods has a secondary support rod located at the rear of the support rod and extending along part of the rear of the support rod.

Preferably the length of the support rod is approximately half to two-thirds that of the main rod, the lower ends of both the support rod and the secondary support rod co-located.

Preferably the secondary support rod has a cross-sectional profile the same shape and size as that of the support rod.

Alternatively the secondary support rod has a cross-sectional profile smaller than that of the main rod.

Preferably the long sides of the support rod are fully radiused.

Preferably the long sides of the secondary support rod are fully radiused.

Most preferably each of the secondary support rods has a cap, the body of which encloses the upper end of the secondary support rod and also encloses the adjacent portion of the main support rod to hold the upper end of the secondary support rod against the main support rod.

Preferably the upper end of the main support rod is fitted with an edge connector to connect the upper end of the support rod to the edge of the trampoline mat.

Most preferably the mat is fitted with mat edge fittings which have a female portion that fits with or corresponds to the edge connector, the edge connector fitting or slotting into the corresponding female connector.

Preferably the mat edge fittings are ganged as a unitary item connected to the corresponding mat edge to form a row of multiple female connectors on that edge of the mat.

Preferably the edge connector is substantially cylindrical, the cylinder aligned substantially horizontally and perpendicular to the longitudinal axis of the support rod.

Preferably the mat edge fitting has connector portions and attachment portions, the connector portions interspersed with the attachment portions in a 1:1 ratio, the attachment portions generally having the form of triangular wedges with two long faces and a convexly curved smaller face located between the two longer faces, each connector portion formed as a hollow elongate structure with a rectangular opening aligned facing inwards towards the centre of the mat and an outwards-facing opening or outer opening, one long face of the wedge positioned against the lower surface of the mat, the second long face sloping towards the mat and the convexly curved portion overhanging the edge of the mat, the trampoline system also having webbing straps passing in a loop around the attachment portion and attached to the mat.

Preferably the mat edge fitting has connector portions and attachment portions, the connector portions interspersed with the attachment portions in a 2:1 ratio, the mat edge fitting generally having the form of a triangular wedge with two long faces and a convexly curved smaller face located between the two longer faces in cross-sectional profile, one long face of the wedge positioned against the lower surface of the mat, the second long face sloping towards the mat and the convexly curved portion overhanging the edge of the mat, the trampoline system also having webbing straps passing in a loop around the attachment portion and attached to the mat, at least the underside of each attachment portion recessed into the mat edge fitting, each connector portion having a recess adapted to receive the edge connector.

Preferably the trampoline system also has an edge accessory attachment system fitted to the top of the mat around substantially the whole perimeter edge.

Alternatively the mat edge fitting has connector portions and attachment portions, the connector portions interspersed with the attachment portions in a 1:1 ratio, the attachment portions generally having the form of triangular wedges with two long faces and a smaller straight face located between the two longer faces.

Preferably the mat edge fitting or attachment component is open internally along the full length of the attachment component.

Preferably each connector portion is formed as recess with and open front and base, with a rear hook portion that extends downwards and inwards from the rear wall of the main body of the recess, and a lip extending downwards at the top front edge.

Preferably the edge connector has a generally T-shaped side profile, the upright connected to and extending along the upper end of the support rod, that arm of the 'T' closest to the mat forming a hook adapted to connect with the rear hook portion, the edge connector having a substantially semi-circular notch across the front face of the edge connector.

Preferably the trampoline system further comprises a catch rod, located at the lower front of the attachment component, and extending the length of the attachment component, the rear of the catch rod locating into the notch to hold the upper end of the support rod in position in the recess.

Preferably the trampoline system further has a plurality of sleeves, each sleeve associated with and at least partly covering and surrounding the free length one of the support rods.

Preferably the lower end of the sleeve is split so as to form two free ends above the point at which the free length extends from the aperture, the two free ends of the sleeve passed one each around the top and the bottom of the frame member and reconnected to each other on the inner side of the frame member to hold the lower end of the rod in position on the frame member.

Preferably the top portion of the sleeve extends beyond the upper end of the support rod and is closed, the upper end of the support rod positioned just outside the edge of the mat, the top portion of the sleeve folded over onto, and connected to, the top surface of the mat.

Alternatively the upper end of the support rod is fitted with a buckle having a main body with a recess on the underside, an outer aperture on the outer side of the body, and a pair of inner apertures located on the inner side of the body, the apertures passing through the buckle, the recess receiving the upper end of the support rod, the buckle located relative to the mat so that the recess is located outside the edge of the mat, the body of the buckle extending over the top of the mat.

Preferably the outer aperture, the recess, and the pair of inner apertures are aligned in a row substantially perpendicular to the edge of the mat, the upper end of the sleeve split to form an outer end and an inner end, the inner end passing up through the outermost one of the inner apertures and down through the innermost one of the inner apertures and extending inwards across and attached to the upper surface of the mat, the outer end passing upwards through the outer aperture, downwards through the innermost one of the inner apertures and extending over the top of the inner end, the outer end attached to the mat, or the inner end, or both.

Preferably the trampoline system also has a foam pad fitted to and over the edge or each edge of the trampoline so as to cover the edge of the mat and provide a cushion, a lower surface of the foam pad fitted with a male connector which corresponds with the attachment rail to connect the foam pad to the trampoline, the male connector fitting between and gripped by the side portions.

Alternatively the trampoline system also has a safety enclosure with a wall or walls corresponding to each side of the mat and extending upwards from the edges of the mat substantially vertically, the wall or walls each having a connector attached to or forming part of the lower edge of the wall, the connector slotting in between the two side portions of the rail so that the base or lower edge of the side wall is connected to the mat, the walls supported by wall members or similar connected between an upper part or portion of the wall and the remainder of the trampoline system.

Alternatively the trampoline system also has a safety enclosure, comprising;

at least one net, a plurality of net support assemblies, each net support assembly having an outer upright aligned substantially vertically, and an inner upright associated with the inner upright, the upper and lower ends of the inner upright connected to the outer upright in such a manner that the body of the inner upright is bowed inwards towards the mat and away from the outer upright, the net support assemblies spaced at intervals along the edge of the mat, the net connected to the inner uprights so that the net forms an inwardly-bowed vertically aligned barrier along the edge of the mat.

Preferably each of the at least one nets has a plurality of sleeves, located and aligned to coincide with the inner uprights, the inner uprights located in the sleeves to connect the net to the inner uprights so that the net forms an inwardly-bowed vertically aligned barrier along the edge of the mat.

Preferably the outer uprights are formed from pultruded fibreglass and have the form of a flat elongate bar with a generally rectangular cross-section, the larger flat faces or sides of the flat elongate bar aligned facing inwards and outwards substantially parallel to the edge of the mat.

Preferably the inner uprights are formed from pultruded fibreglass and have the form of a flat elongate bar with a generally rectangular cross-section, the larger flat faces or sides of the flat elongate bar aligned facing inwards and outwards substantially parallel to the edge of the mat.

Preferably the lower edge of the at least one net is fitted with a net connector, and the mat is fitted with a corresponding rail, the connector and rail interacting to hold the lower edge of the net against the edge of the mat.

Preferably each of the inner uprights is fitted with an upright connector, the rail and upright connector interacting to hold the inner upright in position relative to the mat.

Preferably each of the side assemblies also has a base unit, the lower end of the outer upright connected to the base unit, the base unit resting against the floor or surface on which the trampoline system is located.

Preferably one, some or all of the side assemblies also have a brace, the inner end of the brace connected to the outer surface of the inner upright, the body of the brace extending outwards to connect with the inner face of the outer upright.

Preferably the inner end of the brace connects to the outer surface of the inner upright at or just above the point where the inner upright meets the mat, the body of the brace angled upwards to connect with the inner face of the outer upright.

Preferably the brace is a fibreglass bar having the same cross-sectional profile as the inner and outer uprights.

In a second aspect, the invention may broadly be said to consist in a safety enclosure for a trampoline system, comprising:

at least one net, a plurality of net support assemblies, each net support assembly having an outer upright aligned substantially vertically, and an inner upright associated with the inner upright, the upper and lower ends of the inner upright connected to the outer upright in such a manner that the body of the inner upright is bowed inwards towards the mat and away from the outer upright, the lower edge of the at least one net fitted with a net connector adapted to hold the lower edge of the net against the trampoline of the trampoline system, the net support assemblies spaced at intervals along the edge of the trampoline system, the net connected to the inner uprights so that the net forms an inwardly-bowed vertically aligned barrier along the edge of the trampoline system.

Preferably each of the at least one nets has a plurality of sleeves, located and aligned to coincide with the inner uprights, the inner uprights located in the sleeves to connect the net to the inner uprights so that the net forms an inwardly-bowed vertically aligned barrier along the edge of the mat.

Preferably the outer uprights are formed from pultruded fibreglass and have the form of a flat elongate bar with a generally rectangular cross-section, the larger flat faces or sides of the flat elongate bar aligned facing inwards and outwards substantially parallel to the edge of the mat.

Preferably the inner uprights are formed from pultruded fibreglass and have the form of a flat elongate bar with a generally rectangular cross-section, the larger flat faces or sides of the flat elongate bar aligned facing inwards and outwards substantially parallel to the edge of the mat.

Preferably each of the inner uprights is fitted with an upright connector, the rail and upright connector interacting to hold the inner upright in position relative to the mat.

Preferably each of the side assemblies also has a base unit, the lower end of the outer upright connected to the base unit, the base unit resting against the floor or surface on which the trampoline system is located.

Preferably one, some or all of the side assemblies also have a brace, the inner end of the brace connected to the outer surface of the inner upright, the body of the brace extending outwards to connect with the inner face of the outer upright.

Preferably the inner end of the brace connects to the outer surface of the inner upright at or just above the point where the inner upright meets the mat, the body of the brace angled upwards to connect with the inner face of the outer upright.

Preferably the brace is a fibreglass bar having the same cross-sectional profile as the inner and outer uprights.

The term "comprising" as used in this specification and indicative independent claims means "consisting at least in part of". When interpreting each statement in this specification and indicative independent claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun.

BRIEF DESCRIPTION OF THE DRAWINGS

Further aspects of the invention will become apparent from the following description which is given by way of example only and with reference to the accompany drawings which show an embodiment of the device by way of example, and in which:

FIGS. 7A and 7B show the trampoline of FIG. 2 fitted with an enclosure, the edge of the trampoline fitted with an edge accessory attachment rail that forms a female connector, the lower edge of the enclosure fitted with a corresponding male connector.

FIGS. 10A-10D shows a variant of the sleeve arrangement shown in FIG. 9, with the lower end or ends of the sleeve used to assist in attaching the support rod to the trampoline frame, and the upper end of the support rod fitted with a buckle, the upper end or ends of the sleeve interacting with the buckle and connected to the mat to hold the rod in position relative to the mat.

DETAILED DESCRIPTION OF PREFERRED EMBODIMENTS

Figure 1A:
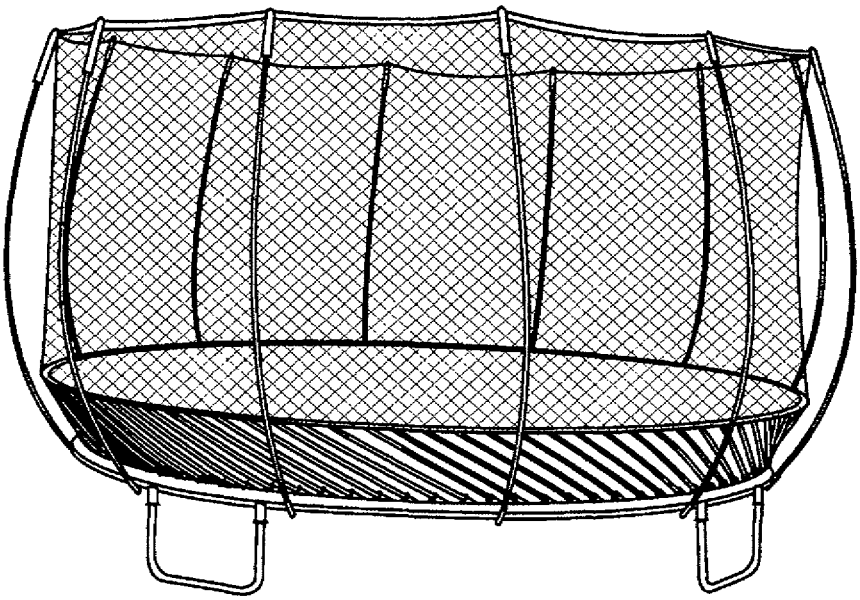
FIG. 1A shows a first form of prior art trampoline system, the trampoline system having a frame, a jumping mat and an enclosure net held above, and surrounding, the jumping mat to form an enclosed jumping area, the frame and jumping mat connected via a number of fiberglass rods extending upwards from the frame to the edge of the mat.
Figure 1B:
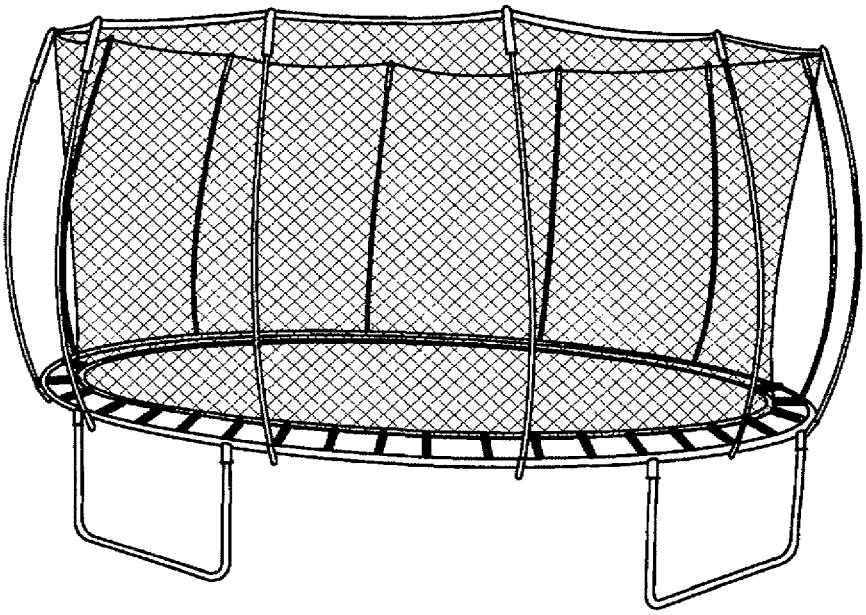
FIG. 1B shows a second form of prior art trampoline system, the trampoline system also having a frame, a jumping mat and an enclosure net held above, and surrounding, the jumping mat to form an enclosed jumping area, the frame and jumping mat connected via a number of springs aligned generally horizontally and extending outwards from the mat to the frame.
Figure 2:
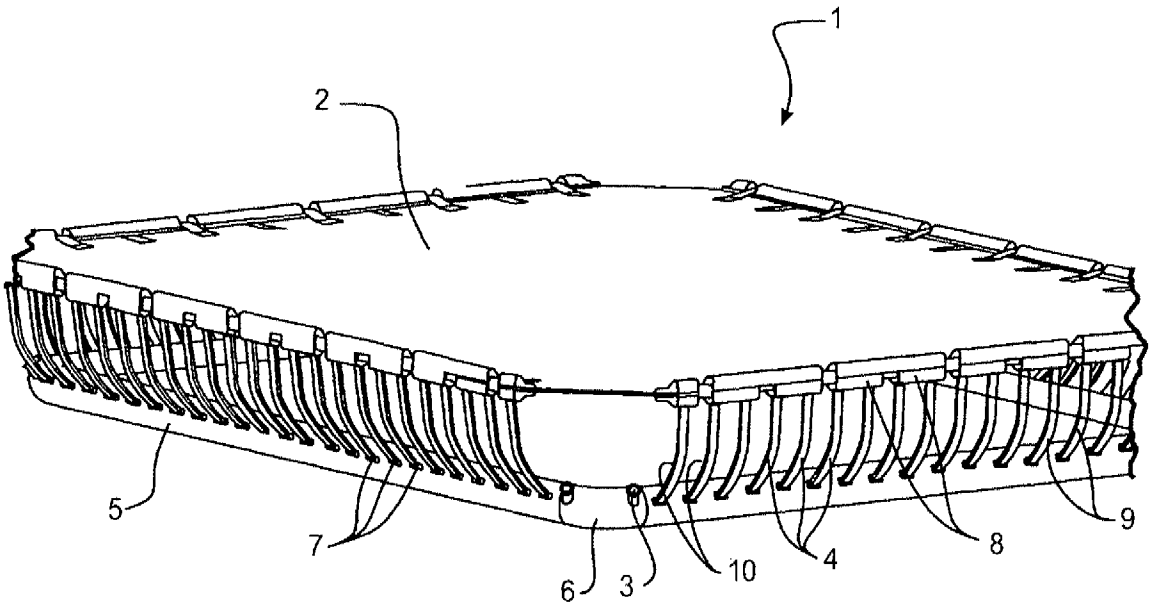
FIG. 2 shows a first preferred form of trampoline, the mat of the trampoline is supported above a frame of the trampoline by a plurality of resiliently flexible rods which extend outwards from the frame to the mat, substantially perpendicular to the frame, the rods curving outwards and upwards from the frame, the upper ends of the rods connected to the periphery of the mat.
Figure 3A:
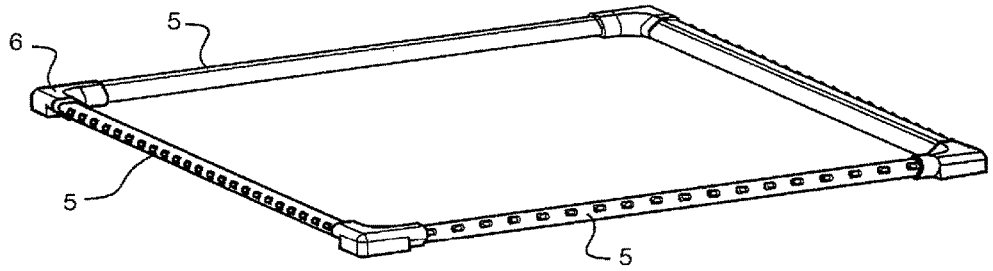
FIGS. 3A-3D show an exploded perspective view of the preferred form of frame for the trampoline, the sides of the frame formed from separate frame members connected at their corners by separate corner connectors to form a hollow rectangle.
Figure 3B:
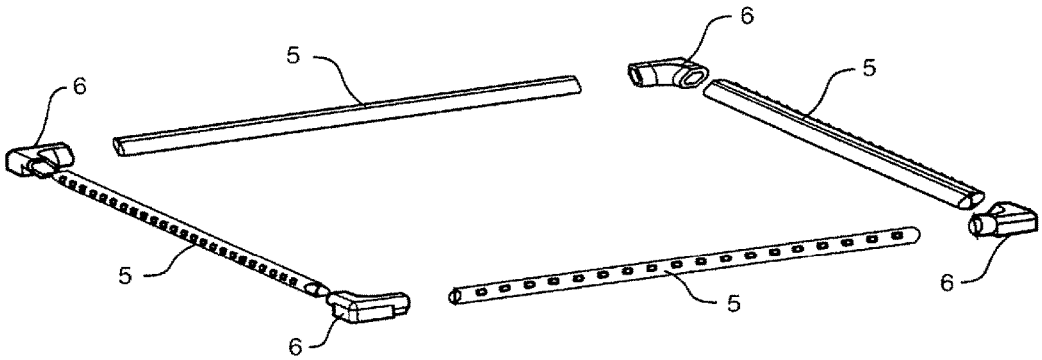
Figure 3C:
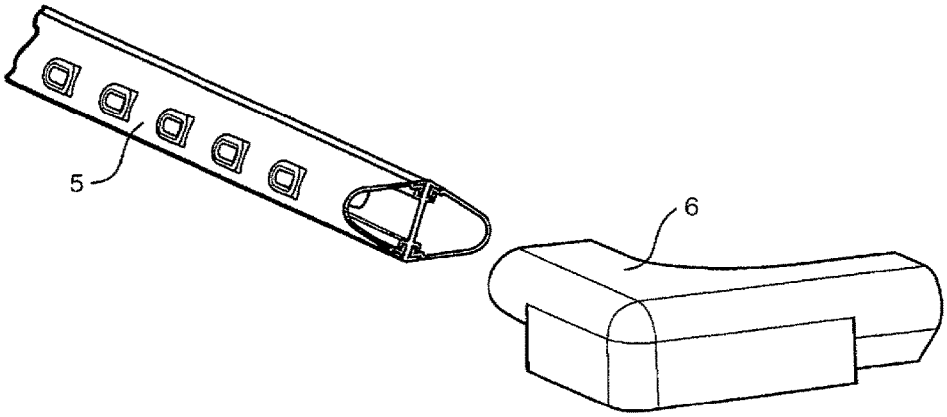
Figure 3D:
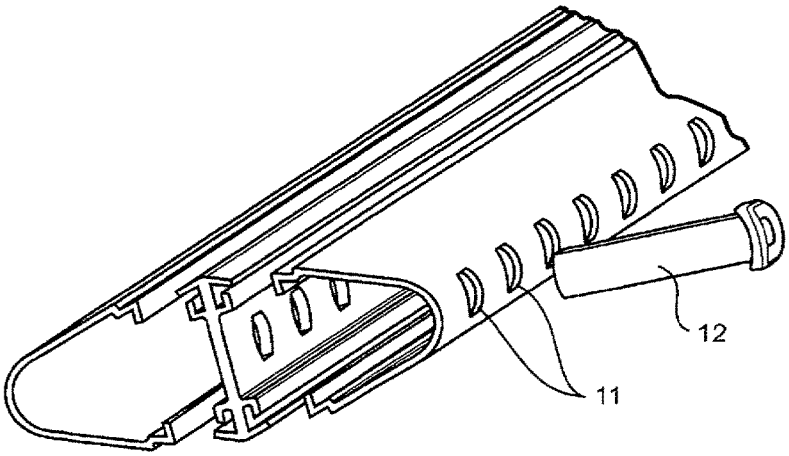

A trampoline system 1 according to the invention is shown in FIG. 2. The trampoline system 1 has a flexible rebounding mat 2 and a frame 3, the mat 2 and frame 3 held in position relative to one another by a plurality of support rods 4.

Frame

The frame 3 of the preferred embodiment is generally rectangular in plan view, with a hollow centre. While the preferred form is rectangular, the frame 3 could have any suitable shape, such as square, oval or circular. In the preferred rectangular form of frame, and with reference to FIG. 3, each side of the frame is formed from a separate frame member 5, the frame members 5 connected at their corners by separate corner connectors 6 to form a hollow rectangle. The preferred material used to form the frame members that form the sides of the frame 3 is steel tubing, with the corner connectors formed from injection moulded plastic.

Mat

The mat 2 has the same shape as the frame 3, but larger, so that when the mat 2 is placed above the frame 3, each edge of the mat 2 overlaps the frame 3. The mat 2 is formed from a resiliently flexibly material such as woven polypropylene.

Support rods

The mat 3 is held above the frame 2 in tension by a plurality of support rods 4. Each of the support rods 4 has a lower end 7 which is connected to the frame 3, and an upper end 8 which is connected to the mat 3. In the preferred embodiment, the lower end 7 is connected to one of the frame members 5 or frame members 5 in such a manner that the lower end 7 is angled outwards and upwards from the frame member 5, with the longitudinal axis of the support rod 4 aligned substantially perpendicular to the longitudinal axis of the frame member 5. Each support rod 4 has a free length 9, which is that length of the rod between the upper end 8 (connected to the mat) and the lower end 7 (connected to the frame). The free length 9 bows, bends or extends outwards from the frame 3 (more specifically, the hollow centre of the frame 3) along the entirety of the free length to form an outwardly bowed arc.

The support rods 4 are, in the preferred embodiment, formed from fibreglass or a similar material. The support rods 4 are formed as flat bars—that is, elongate members with a square or more preferably rectangular cross-section. However, the rods 4 can be formed to have any other suitable cross-sectional shape. The support rods 4 are flat or straight when no external force is applied—that is, they are not pre-formed with a curve. The sides of the rods (that is, the narrower ones of the longer faces aligned along or with the longitudinal axis of the rod) are, in the preferred embodiment, fully radiused.

In the most preferred form, the rods 4 form a row along each side of the frame 2 and mat 3. The corners of the trampoline do not have support rods associated with them. In the most preferred form, the corners of the rectangular mat 3 are 'cut off' diagonally between the end one of each row of support rods, to avoid an unsupported or loose portion of material at the corner.

In the most preferred form, each of the support rods 4 includes a secondary support rod or bar 10 or half-bar 10 connected to the rear of the main support rod 4. The length of the support rod is approximately half to two-thirds that of the main rod. The lower end of the secondary support rod 10 is also connected to the frame 3, so that the secondary support rod 10 extends along the rear of the main support rod 4 for approximately half to two-thirds the length (the lower half) of the support rod 10. The secondary support rod 10 is also straight or un-curved when no external force acts on it.

The preferred form of the secondary support rod 10 has a cross-sectional profile the same shape and size as the main rod. However, the support rod can have any suitable cross-sectional shape and size, and could for example have a rectangular cross-section that is smaller than the cross-section of the main support rod.

It should be noted that the use of the secondary support rod 10 is preferred, but not absolutely necessary. In this specification, references to support rods should not be taken to mean always inclusive or always exclusive of the secondary support rod: the reference could be to a support rod by itself (support rod 4), or to a support rod formed from support rod 4 in combination with a secondary support rod 10.

Figure 4A:
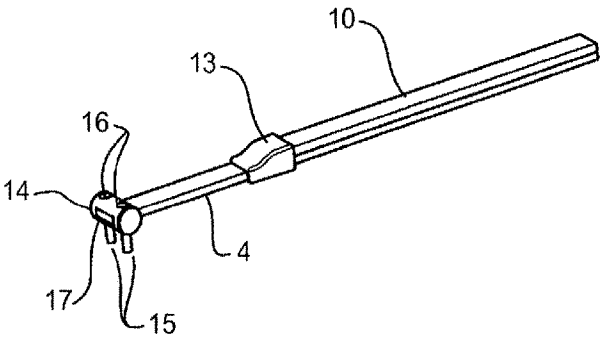
FIG. 4A shows the preferred form of resiliently flexible support rod, the support rod having a main support rod and a secondary support rod.
Figure 4B:
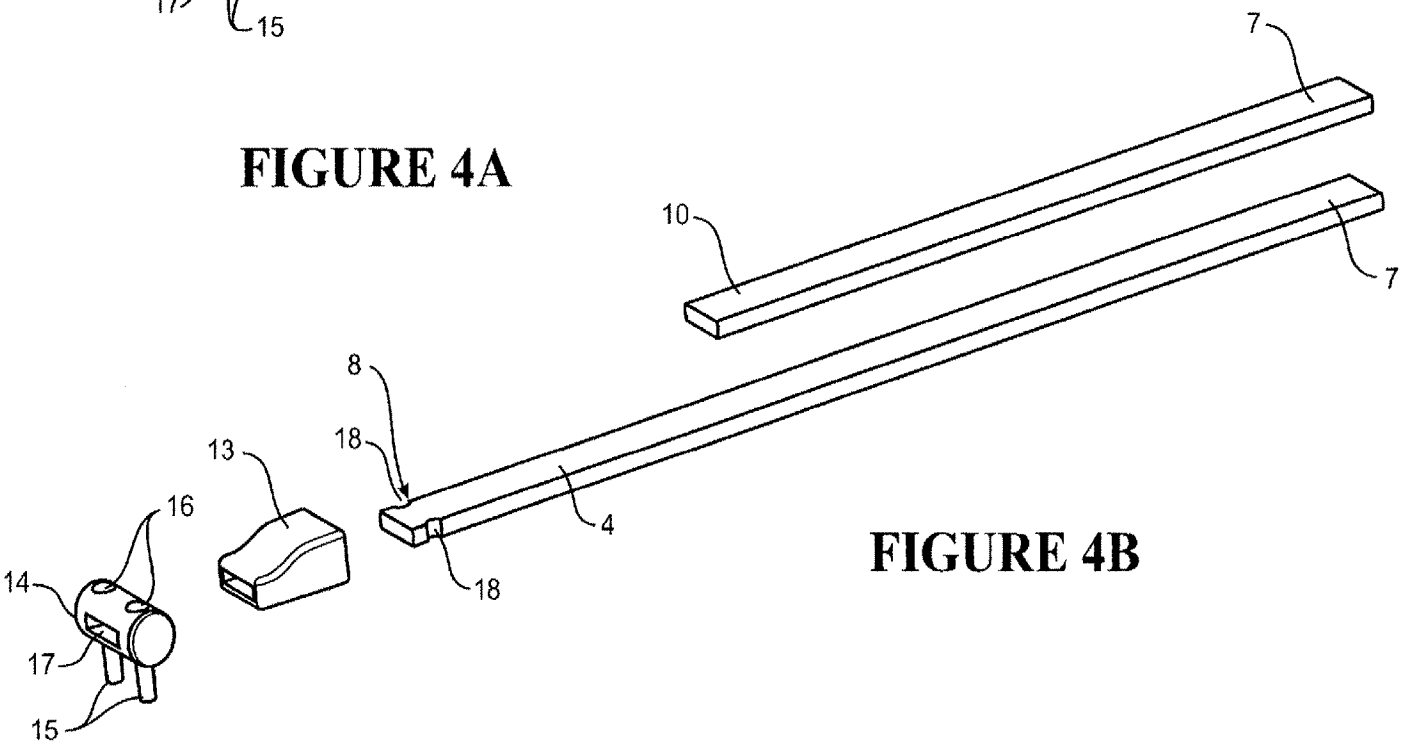
FIG. 4B is an exploded view of same.

The preferred form of main support rod 4 and secondary support rod 10 is shown in FIG. 4A, and exploded in FIG. 4B.

The lower end of each of the support rods 4 and rods 10 are connected to the frame as follows: a series of holes or apertures 11 are formed in a row along the frame tubes 5, along the outer side of the frame tube 5 and slightly towards the upper part of the frame tube 5. The lower ends 7 of the support rods 4 and secondary support rods 10 are inserted into these apertures 11. The sides of the apertures can be reinforced with a support insert 12 or similar if required. As described above, the free length 9 curves upwards and outwards from the frame 2 to the mat 3. The curve of the main support rod 4 also causes the secondary support rod to bend or curve outwards to follow the curve of the main support rod 4.

In the most preferred form, the secondary support rods have a cap 13, the body of which encloses the upper end of the secondary support rod 10 and also encloses the adjacent portion of the main support rod 4 to hold the upper end of the secondary support rod against the main support rod 4. In practice, as the curve bends the main support rod 4 backwards against the secondary support rod, the two rods are forced against one another along the length of their contacting faces.

In one embodiment, the upper end 8 of the main support rod 4 is fitted with an edge connector 14 to connect the upper end 8 to the edge of the mat 2 in co-operation with an edge fitting fitted to the edge of the mat. The edge connector and the co-operative relationship will be described in more detail below. In the preferred form the edge connector 14 has the general form of a cylinder with its axis aligned horizontally, and perpendicular to, the longitudinal axis of the support rod 4. The cylindrical edge connector 14 has a slot 17 which passes through the centre of the cylinder perpendicular to the longitudinal axis, to allow the edge connector 14 to be slipped over the end of the support rod 4. The edge connector 14 also has a pair of holes 16 which are aligned at right angles to the slot, and a pair of corresponding pins 15. The pins 15 and holes 16 correspond to a pair of notches 18 on the support rod 4, just behind the tip of the upper end 8. The edge connector 14 is held in place on the end of the rod 4 by the pins, which pass through the edge connector 14 and through the notches 18. If required, one end of the holes 16 can be countersunk to correspond to a wider end on the pin 15, this countersinking stopping the pin passing all the way through the hole 16 and potentially dropping out of the hole 16.

There are two preferred ways in which the pins may be formed.

The first method is as follows: the pins 15 are moulded as one piece with the edge connector 14. A thin diaphragm is used to connect the pins 15 to the edge connector 14 to allow the cavity to fill. To fit the edge connector 14 to the rod, the pines 15 are pressed in and the diaphragm shears through.

The second method is to form two separate pins separately from the edge connector, and to press them into place.

Mat Edge Rod Connection

There are several ways in which the support rods can be connected to the edge of the mat. Several preferred ways shall now be described.

Webbing Sleeve

A first preferred embodiment is shown in FIG. 9. Each of the support rods (and secondary support rods if used) is fitted with a sleeve 33. The preferred form of sleeve is two generally flat pieces of material connected by sewing or similar along each long edge. The sleeve is slipped over the rod so that the seams along each long edge align with the smaller sides or faces of the support rod. The lower end of the sleeve 33 is split. That is, the two edges are not connected at the lower end. The two faces of the sleeve are left intact, and the result is that two free ends 35 are formed at the lower end. The non-connected or split portion starts just above the point at which the free length 9 of the support rod 4 extends from the aperture 11. The two free ends 35 of the sleeve are passed one each around the top and the bottom of the frame member 5. The two free end 35 are reconnected to each other on the other side or inner side of the frame member 5, preferably by stitching or similar, to hold the lower end 7 of the rod 4 in position on the frame member 5.

The first preferred way to attach the upper end 8 to the mat is as follows: the top portion 34 of the sleeve is closed, and extends beyond the upper end 8 of the support rod 4. The upper end 8 of the rod 4 is positioned just outside the edge of the mat 2 and the top portion of the sleeve is folded over onto the top surface of the mat, and stitched into place to hold the support rod 4 in position.

Figure 10A:
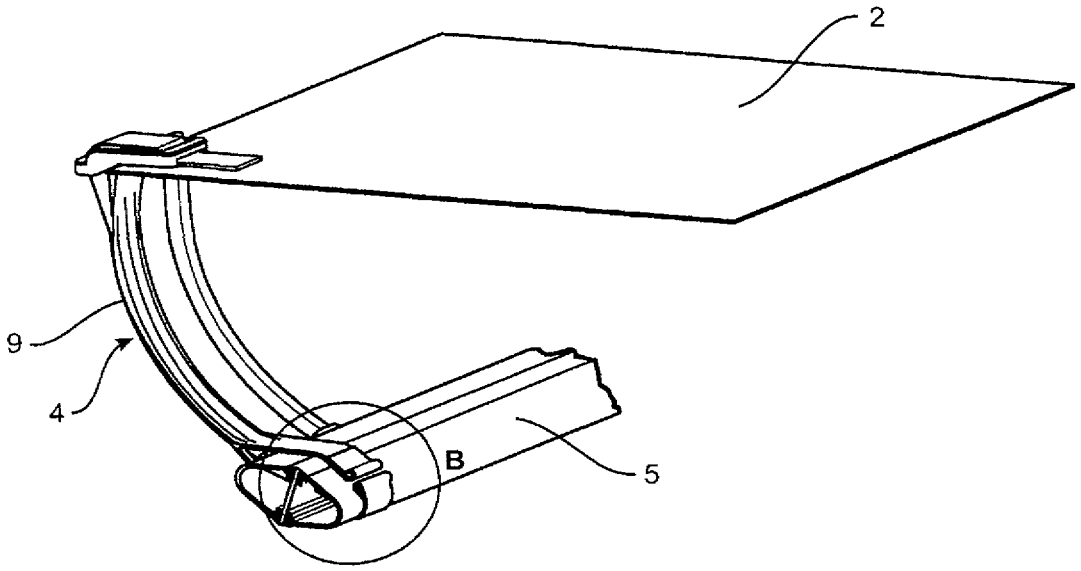
Figure 10B:
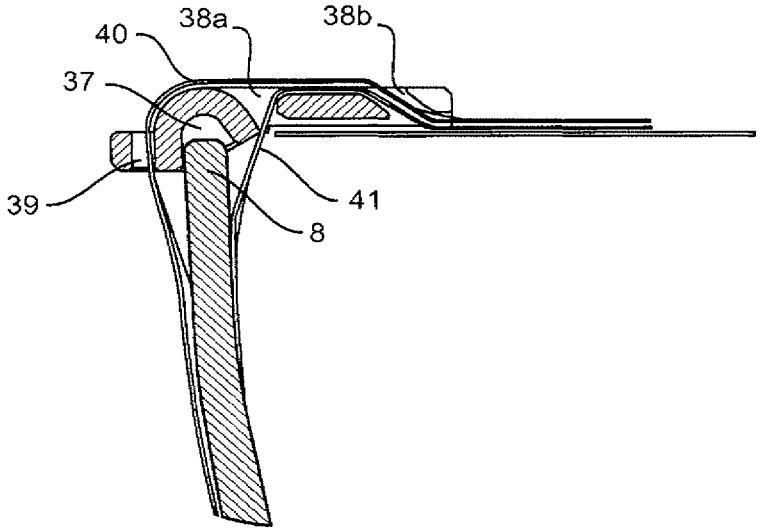
Figure 11A:
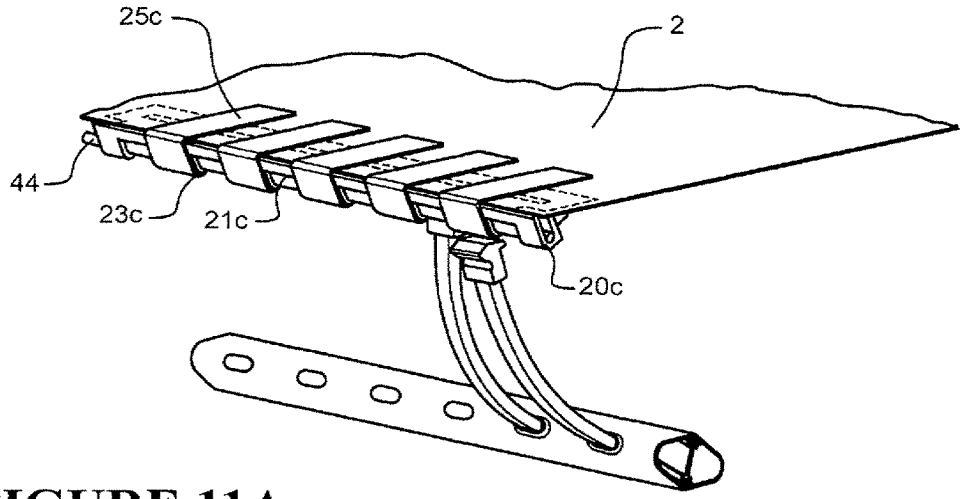
FIGS. 11A-11D shows another form of component used for connecting the upper end of the support rods to the mat, a single attachment component forming a gang of female connectors aligned in a row, the female connector portions alternating with attachment portions, the attachment component open internally along the full length of the attachment component, the attachment component having a rear hook portion that forms part of the rear wall of the main body of the recess, the front and base of the attachment component open except for a lip at the top front edge of the main body of the attachment component, the support rod fitted with an edge connector with a generally T-shaped outline, a catch rod running along the lower front internal corner of the attachment component.
Figure 11B:
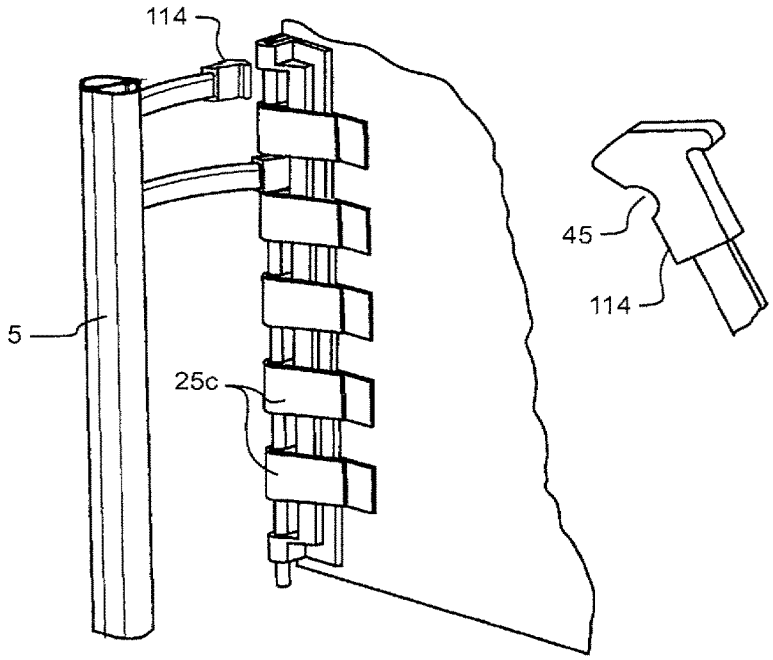
Figure 11C:
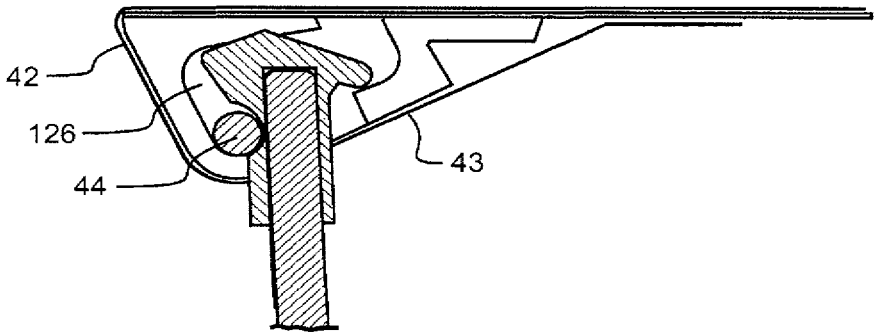
Figure 11D:
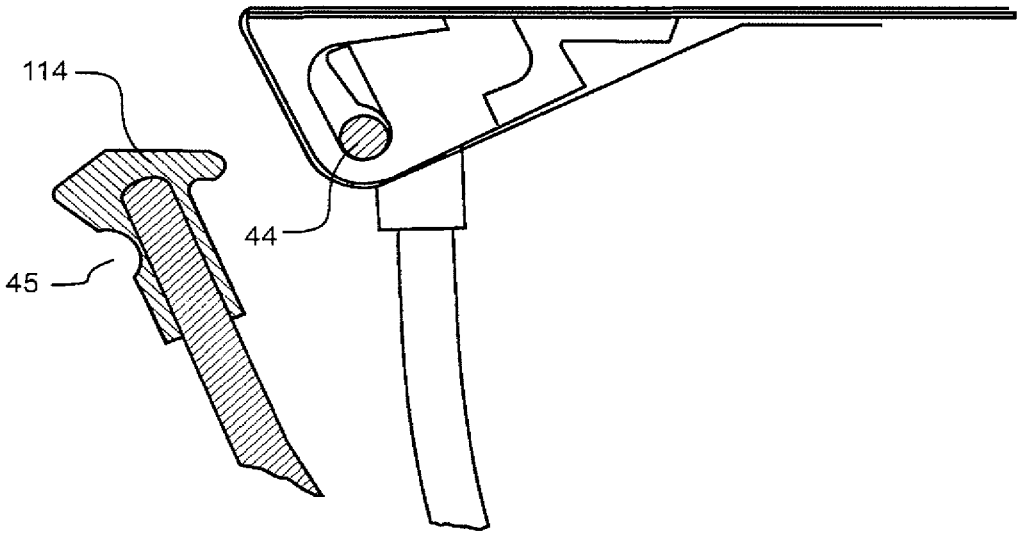

The second preferred way to attach the upper end to the mat is as follows: the rod is fitted with sleeve 33 as described above. The lower end is connected to the frame member 5 in the same manner as described above. However, in this embodiment, and with reference to FIG. 10, the upper end 8 of the support rod 4 is fitted with a buckle 36. The buckle 36 has a main body, with a recess 37 on the underside, and an outer aperture 39 on the outer side of the buckle, on the outer side of the recess 37. A pair of inner apertures 38*a* and 38*b* are located on the inner side of the body of the buckle 36, with the aperture 38*a* closer to the edge of the mat and the recess 37 than the aperture 38*b*. The outer aperture 39, the recess 37, and the inner apertures 38*a* and 38*b* are all aligned in a row, substantially perpendicular to the edge of the mat 2. All of the apertures 38*a*, 38*b*, and 39 pass through the buckle 36 from top to bottom. The upper end 8 of the support rod 4 slots into the corresponding recess 37 in the body of the buckle 36. The buckle 36 is located relative to the mat so that the recess 37 is just outside the edge of the mat 2, with the majority of the body of the buckle 36 extending over the top of the mat 2, so that the apertures 38*a* and 38 *b* are positioned over the top of the mat 2. In this embodiment, the upper end of the sleeve 33 is also split into two free ends—an outer end 40 and an inner end 41. The inner end 41 passes up through the aperture 38*a* and is folded inwards across part of the body of the buckle 36 and down through the aperture 38*b* and then extends inwards onto the upper surface of the mat 2, where it is connected or attached in any suitable fashion to the mat 2, but most preferably by sewing or stitching. The outer end 40 passes upwards through the aperture 39 and is then folded across the top of the buckle 36, passing downwards through the aperture 38*b* over the top of the inner end 41 and is connected in any suitable fashion but preferably by sewing or stitching to the mat over the top of the inner end 41. Use of the buckle 36, and in particular the manner in which the upper end 8 is inserted into the recess 37 of the buckle 36, helps to prevent wear on the components of the trampoline.

The sleeve can also be used in conjunction with a plastic insert (not shown) that is located over the main body, or free length, of the support rod, between the support rod and the sleeve, the plastic insert supporting the support rod and helping to prevent wear and tear on the support rod during use.

Edge Connectors

Figure 5A:
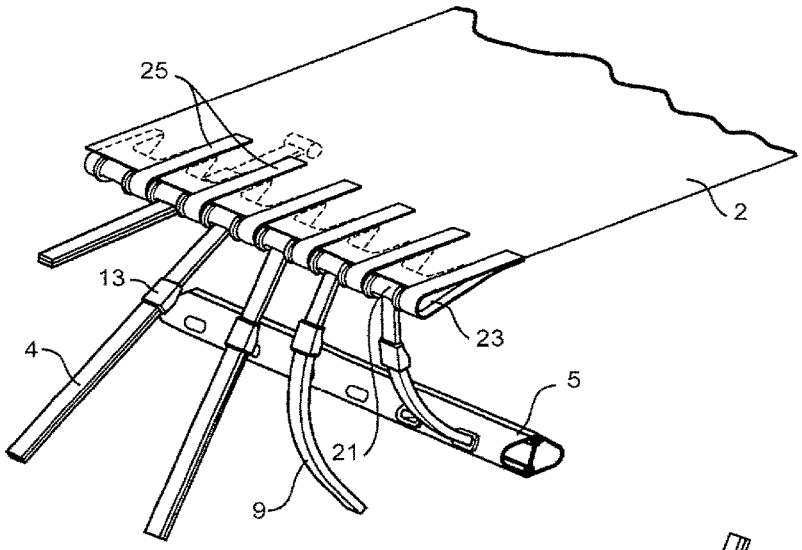
FIGS. 5A-5C show a first preferred component used for connecting the upper end of the support rods to the mat, a single attachment component forming a gang of female connectors aligned in a row, the female connector portions alternating with attachment portions, each connector portion having a hollow elongate form with a rectangular opening aligned facing inwards towards the centre of the mat and an outwards-facing opening or outer opening.
Figure 5B:
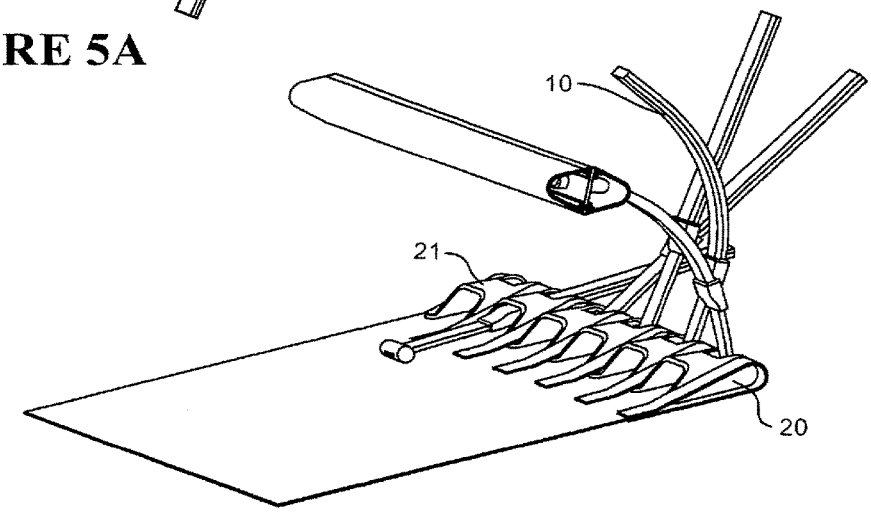
Figure 5C:
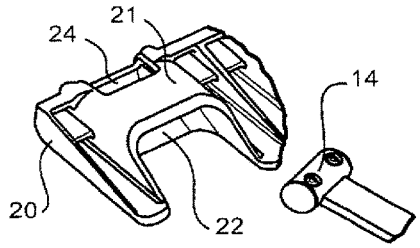
Figure 6A:
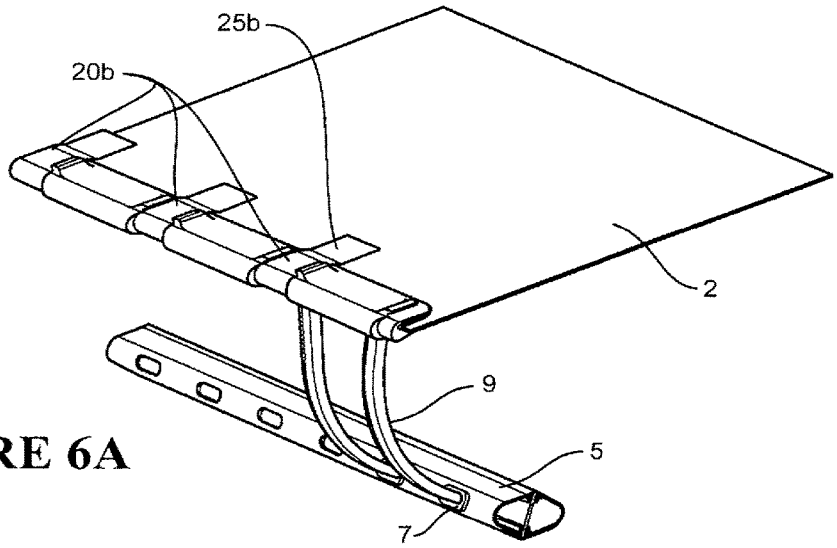
FIGS. 6A-6E show second form of attachment component shown in FIG. 5, a single attachment component forming a gang of female connectors aligned in a row, with the female connector portions interspersed with attachment portions in a ganged female row in a 2:1 ratio of female connector portions to attachment portions, the female connector portions having a recesses which in use receive an edge connector on the upper end of the support rod.
Figure 6B:
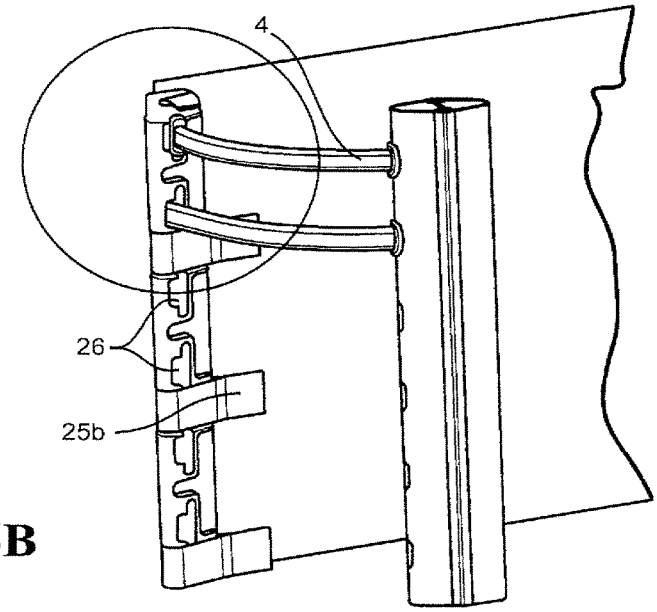
Figure 6C:
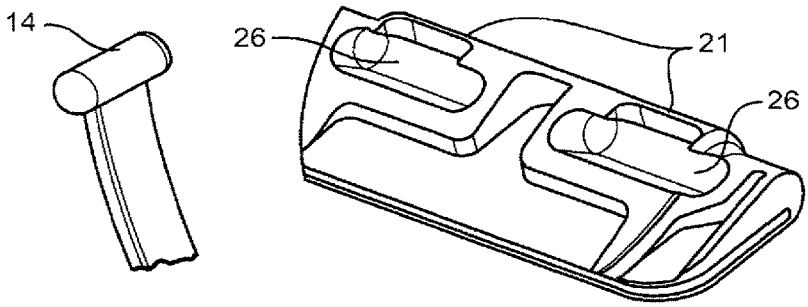
Figure 6D:
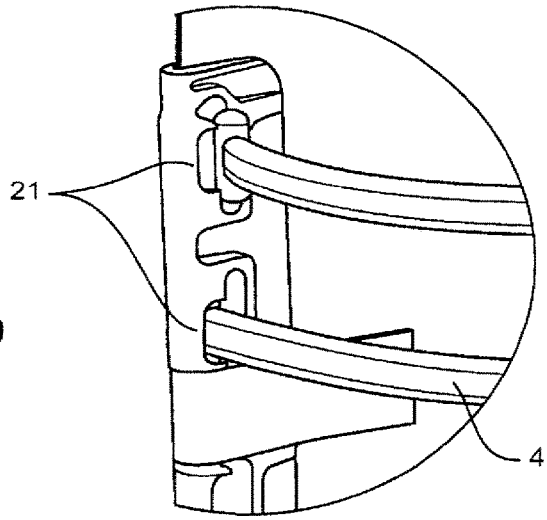
Figure 6E:
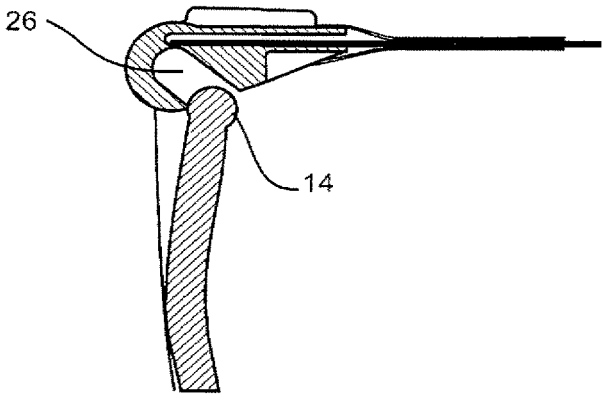

The edge connector 14 is used as a part of a mechanism to connect the upper end of the support rod 4 to the edge of the mat 2. In the preferred form, the mat 2 is fitted with a mat edge fitting or fittings which fit with or correspond to the edge connector 14. In the preferred form, the mat edge fittings are female connectors which correspond to the male edge connector 14. The female connectors are ganged in a single unitary item which is then connected to the edge of the mat to form a row of multiple female connectors on the edge of the mat 2. In the preferred form, the ganged female connectors are formed as a separate component to the mat 2, and then connected to the edge of the mat 2. A first preferred way to connect the ganged female connectors is shown in FIG. 5. The ganged female connectors are formed as a single attachment component 20*a* with the female connectors aligned in a row. In attachment component 20*a*, connector portions 21 alternate with attachment portions 23. Each connector portion 21 has a hollow elongate form with a rectangular opening 22 aligned facing inwards towards the centre of the mat and an outwards-facing opening or outer opening 24. The connector portions 21 are interspersed with attachment portions 23 in a 1:1 ratio. The attachment portions 23 have the form of generally triangular wedges with two long faces and a convexly curved smaller face between the two longer faces. One long face of the wedge is positioned against the lower surface of the mat. The second long face (opposite the first) slopes towards the mat 2 with the thin end of the wedge aligned pointing or facing towards the centre of the mat 2. The attachment component 20*a* is positioned along one edge of the mat so that the convexly curved portion at the thick end of the wedge slightly overhangs the end of the mat 2. Lengths of webbing or webbing straps 25 are sewn to the mat so that they pass in a loop around the attachment portion 24, fitting snugly to the attachment portion 23. These straps hold the attachment component 20 in position on the mat. The attachment component 20*a* is prevented from slipping sideways through the webbing loops by the connector portions 21, which have a side profile that overhangs or extends above the sides of the wedge shape of attachment portion 23, preventing sideways movement through the webbing loop.

As part of the assembly of the trampoline system 1, the lower end 7 of the support rod 4 is passed through the connector portions 21 from the inside, extending out through the outer opening 24. The upper end 8 is fitted with the edge connector 14. The connector portions 21 and edge connector 14 mutually fit together in such a way that the edge connector 14 is held in position inside the connector portion 21, but can rotate around an axis parallel to the edge of the mat 2. The range of rotation is not required to be more than a few degrees each way in use. The support rod 4 is then flexed or bent with the lower end located in the aperture 11.

A variation of the attachment component described above—attachment component 20*b*—is shown in FIG. 6. The attachment component 20*b* is similar to the component 20*a* described above. However, in this variant, the connector portions 21*b* are interspersed with attachment portions 23 in a 2:1 ratio. The 'female' component or connector portions 21*b* of the attachment component 20*b* are recesses 26. The edge connector 14 is fitted into the recess 26 from below, and can rotate around an axis parallel to the edge of the mat in a similar manner to that described above. Also as above, the range of rotation is not required to be more than a few degrees each way in use. As above, a webbing strap 25*b* passes around the connector portion 21*b* from the top of the mat 2 to the underside to hold the elongate attachment component 20*b* in position. Sideways movement of the attachment component 20*b* is prevented by the connector portion 21*b* being slightly inset into the elongate attachment component 20*b*.

Yet another variation of the edge connection mechanism is shown in FIG. 11. A third variant of mat edge fitting or attachment component—attachment component 20*c*—is shown connected to the edge of the mat 2. The attachment component 20*c* is similar to both the components 20*a* and 20*b* described above. Connector portions 21*c* alternate with attachment portions 23*c* in a 1:1 ratio. In a similar manner to that described above, the attachment component 20*c* is connected to and along the edge of the mat by a series of webbing straps 25*c* that are looped over the attachment component 20*c* with the ends stitched or sewn to the upper and lower surfaces of the mat 2, the webbing straps aligned substantially perpendicular to the edge of the mat 2 and passing across and over the attachment portions 23*c*.

In this embodiment, the recess 126 is formed so that the attachment component 20*c* is open internally along the full length of the attachment component 20*c*. The recess 126 is shaped so that it contains a rear hook portion 43 that extends downwards and inwards from, and forms part of, the rear wall of the main body of the recess 126. The front of the attachment component 20*c*, opposite the hook portion 43, is open, as is the base, except for a lip 42 at the top front edge of the main body of the attachment component 20*c*, extending downwards.

In this embodiment, the upper end 8 of the rod 4 is fitted with an edge connector 114 that has a generally T-shaped outline from the side. The upright is connected to and extends along the upper end of the rod. The rear (or right) arm of the 'T' forms a hook with a rear top surface that is angled upwards (from right to left) in relation to the lower surface of the arm (if the 'T' shape were viewed with the upright vertical). The front arm of the 'T' is shaped by forming a semi-circular notch 45 across the front face of the edge connector 114. The portion of the edge connector 114 above the notch forms a front face that slopes inwards from the top of the arm, the upper face sloping upwards to an apex where it meets the rear top surface.

A catch rod 44 is passed in through one of the open ends of the attachment component 20*c*. The rod 44 is the same length as the attachment component 20*c*. The body of the catch rod 44 rests at the lower front internal corner of the attachment component 20*c*. The preferred form of rod is circular in cross-section.

The lower end of the support rod 4 is attached to the frame in a similar manner to that outlined above. When the lower end is first connected to the frame, the support rod 4 extends upwards and outwards from the frame. To connect the support rod 4 to the attachment component 20*c*, the upper end 8 of the support rod 4 is bent backwards/inwards towards the mat 2 and the connected attachment component 20*c*. The angled rear top surface or face pushes the catch rod 44 upwards within the recess. When the upper end is pushed fully backwards towards the mat, the catch rod 44 passes over the top of the edge connector 114 and down the front face. The notch 45 has substantially the same radius as the rod 44. The spring energy contained in the rod from being bent backwards towards the mat 2 causes the upper end of the rod 4 to move outwards. However, once the rod 44 drops over the front face, and the notch 45 moves forward as the upper end of the support rod 4 moves outwards, the notch 45 moves forward over and around that portion of the body of the rod 44 which is next to the notch 45, the rod 44 preventing the upper end of the support rod 4 from moving out of position within the attachment component 20*c*. The rear arm of the 'T' slots into and over the hook portion 43.

Inside the recess 126, the top surface of the recess bears down on the portion of the edge connector 114 above the notch which forms a front face that slopes inwards from the top of the arm.

In use, the rear arm of the 'T' slots into and over the hook portion 43 to allow some movement of the rod and the attachment component 20*c* relative to one another as a user bounces on the mat 2. Similarly, there is a space between the inner wall of the recess 126 and the front face of the front arm of the 'T' to allow some movement of the rod and the attachment component 20*c* relative to one another.

Edge Accessory Attachment System

The trampoline system 1 also has an edge accessory attachment system. In one embodiment the rail 27 is fitted to the top of the mat 2 around substantially the entire perimeter edge of the mat 2 (except for the corners in the preferred embodiment). The edge accessory attachment rail 27 is an extruded rail, having a continuous base 28 and two side portions 29 that extend upwards from each side of the base 28 to form an arch shape. The base 28 lies flat against, and is attached to, the mat 2. The top of the arch formed by the two side portions 29 is an open slot. The side portions 29 are not continuous: there are gaps at intervals on each side. In the embodiment shown, this is to allow the rail 27 to be connected to the mat 2 by straps (not shown) which loop around the rail 27 and the edge of the mat 2 with the ends pointing inwards. The ends of the straps are connected by stitching or similar to the mat 2 to hold the rail in position, a portion of the body of each of the straps located in one of the gaps.

An alternative way to connect the rail 27 to the mat 2 is to use a single fastener on the bottom or base 28 of the rail, for example by passing the fastener through the base 28 and the mat 2 to connect the mat 2 and the rail 27 in a manner which does not require the gaps in the side portions 29.

Figure 8:
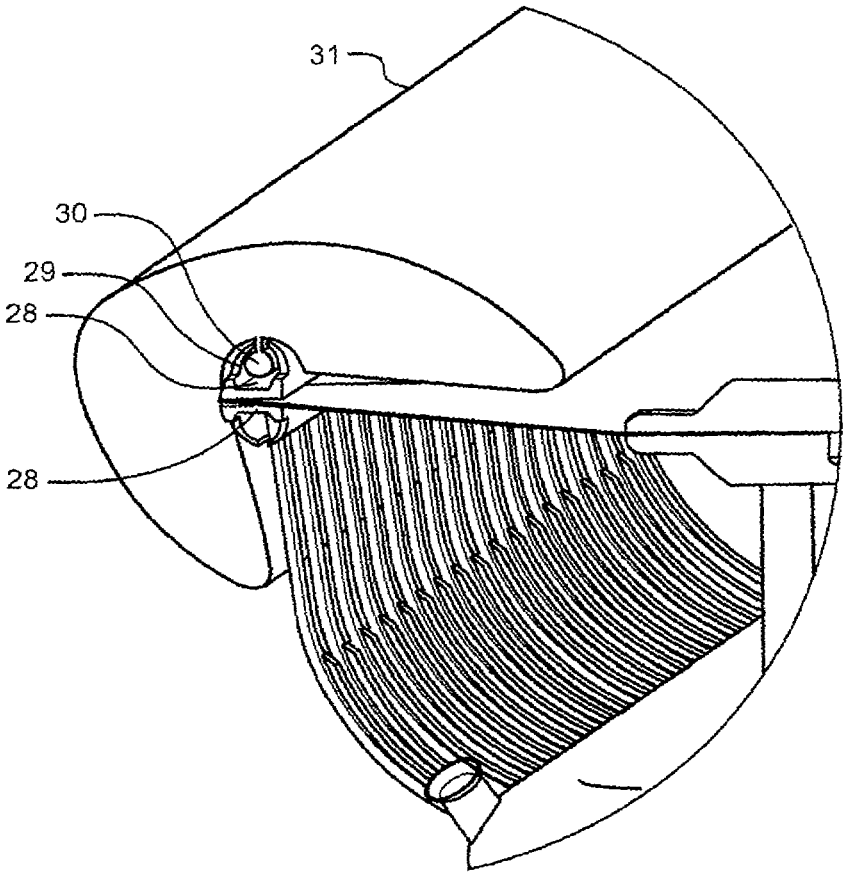
FIG. 8 shows a foam pad fitted to and over the edge of the trampoline to cover the edge of the mat and any hard or rigid items on or close to the edge of the mat, the edge of the trampoline fitted with an edge accessory attachment rail the same or similar as that shown in FIG. 7.
Figure 9A:
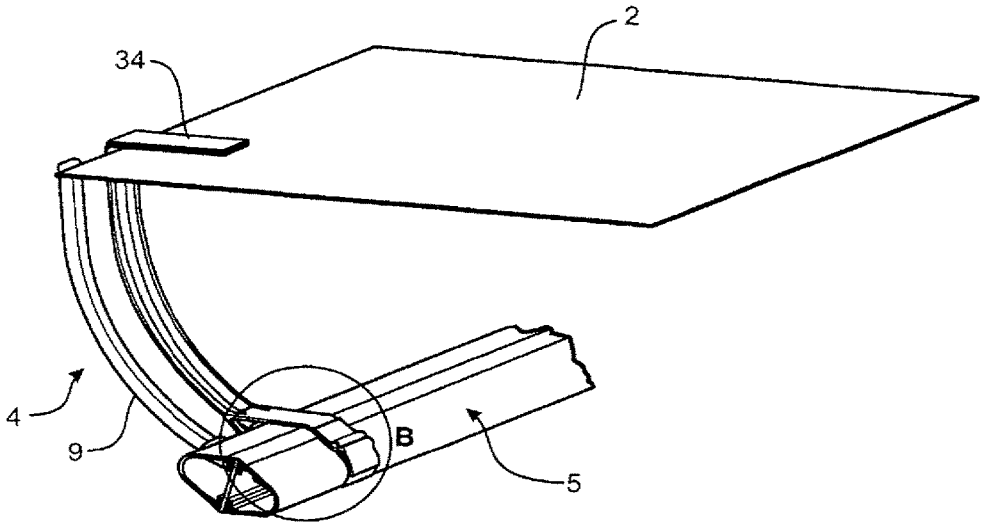
FIGS. 9A-9D shows a sleeve that is fitted over the support rod, the lower end or ends of the sleeve used to assist in attaching the support rod to the trampoline frame, the upper end or ends of the sleeve connected to the mat to hold the rod in position relative to the mat.
Figure 9B:
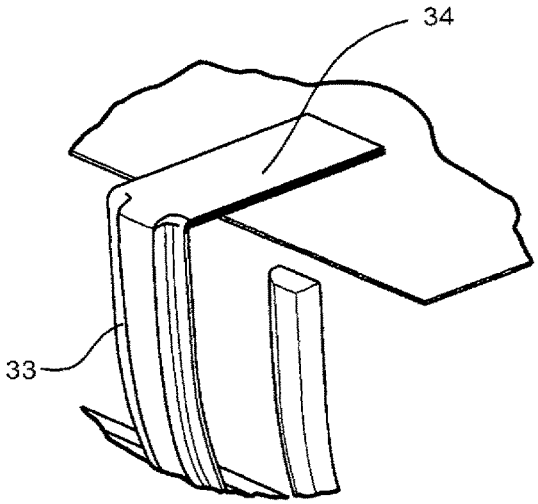
Figure 9C:
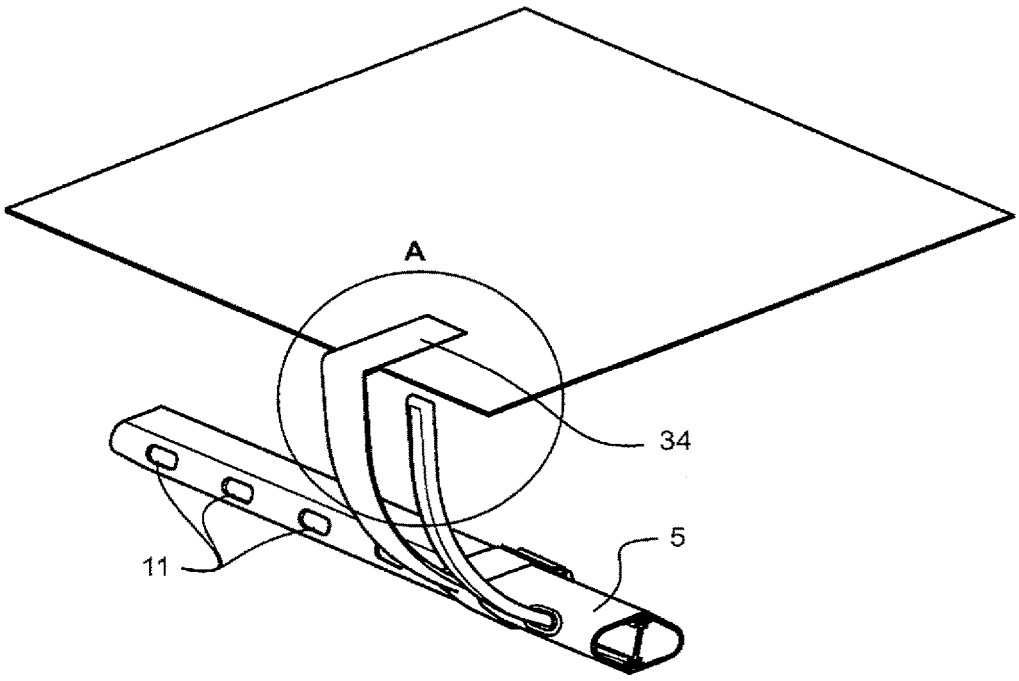
Figure 9D:
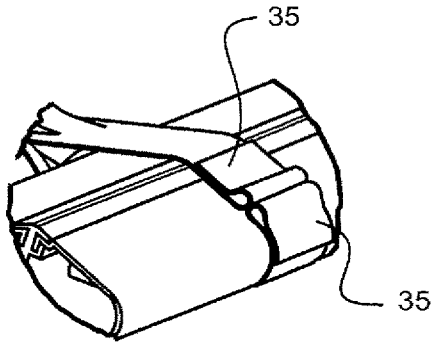

Accessories for the trampoline system 1 are fitted with a connector 30 that corresponds to the attachment rail 27. The connector 30 fits between the sides 29 of the arch, the sides 29 forming a female portion and the connector 30 forming a male portion which interlock. The connector 30 extends upwards through the slot and is connected to the main body of the accessory. The accessory can for example be an item such as the wall of a safety enclosure or similar such as for example the enclosure wall 32 shown in FIG. 7. The connector 30 is attached to or forms part of the lower edge of the wall of the enclosure, and as shown in FIG. 7 slots into the rail 27 so that the base or lower edge of the side wall is connected to the edge of the trampoline mat. Alternatively the accessory could be a foam pad 31 such as the one shown in FIG. 8, which is fitted to and over the edge of the trampoline 1 to cover the edge of the mat 2 and also any hard or rigid items on or close to the edge of the mat 2. The foam pad 31 provides a cushion which can help to prevent injury if a user falls at or close to the edge of the mat 2. As shown in FIG. 8, a lower surface of the foam pad 31 is fitted with the connector 30, which fits into the slot on rail 27 to connect the foam pad 31 to the trampoline.

Four preferred forms or variants of accessory attachment system suitable for use with the trampoline will now be described. For each of the first two preferred forms, as shown in FIGS. 7*b* and 8, the accessory attachment system has two main parts: an accessory attachment rail 27 fitted in use to the trampoline 1, and a connector 30 that corresponds to the attachment rail 27, and which is fitted to the accessory.

For both of these first two preferred embodiments, the accessory attachment rail 27 is an extruded rail, having a continuous base 28 and two side wall portions 29 that extend upwards and angle inwards over the base, one from each side of the base 28. An open slot is formed in the top of the structure formed by the two side portions 29. Although it is preferred that the slot is open, the two edges could be touching each other, and forced apart when the accessory is pulled into the slot. It can be seen that the accessory attachment rail is a hollow structure with a slot at the top.

In the first two preferred forms as shown in FIGS. 7*b* and 8, the side wall portions are co-extruded with the base 28, but could, if required, be manufactured separately and then connected to the base.

The accessory attachment rail is, in the preferred use, fitted to the top of the mat around substantially the entire perimeter edge of the mat (except for the corners in the preferred embodiment—the rail in this embodiment is actually four separate (sub-)rails, which are fitted one to each edge). However, it should be noted that the rail could be fitted to the trampoline wherever it is required—e.g. close to the centre of the mat, on the frame, on the enclosure, etc. The base 28 lies flat against, and is attached to, the mat. In the first preferred embodiment shown in FIG. 7*b*, the side portions 29 are not continuous: there are gaps at intervals on each side. This is to allow the rail to be connected to the mat by straps (not shown) which loop around the rail and the edge of the mat with the ends pointing inwards. The ends of the straps are connected by stitching or similar to the mat to hold the rail in position. A portion of the body of each of the straps is located in one of the gaps, passing across and preferably contacting the inner surface of the base 28.

In the second preferred embodiment shown in FIG. 8, the side portions 29 are continuous. The rail is connected to the mat by fasteners on the bottom or base of the rail. The fasteners 9 can be rivets or similar.

Accessories for use with the trampoline are fitted with a connector 30 that corresponds to the attachment rail. Alternatively, the connector 30 could be integrally formed with the accessory. In the preferred embodiment, the connector 30 has a main body portion that fits between the sides 29 of the rail, and an extension portion that extends from the main body upwards through the slot to the accessory. The connector 30 fits between the sides 29, the sides 29 forming a female portion that corresponds to the male portion 30, the male and female portions interlocking in use. That is, the sides 29 curve or angle around the main body portion of the connector 30 to hold the accessory in position. The extension portion extends upwards through the slot 17 to connect with the main body of the accessory.

The preferred manner in which an accessory is fitted to the trampoline is by sliding one end of the connector 30 between the sides 29 from one open end of the rail. However, in the most preferred embodiment, the main body portion of the connector is formed from a non-rigid foam, and it is possible to push the main body portion directly down through the slot into the rail, the connector body contracting and then expanding again once it is between the sides 29, the sides 29 also bending outwards and then back into position once the main body has been fully pushed down through the slot.

In the first preferred embodiment described above, with gaps in the side walls, then the connector 30 passes over the top of the strap(s).

The arrangement described above can be used to attach a number of different accessories to the trampoline. The accessory could be an edge protector pad such as the foam pad 31 shown in FIG. 8, which is fitted to and over the edge of the trampoline to cover the edge of the mat and also any hard or rigid items on or close to the edge of the mat. The foam pad provides a cushion which can help to prevent injury if a user falls at or close to the edge of the mat. Another benefit is that by completely attaching the pad, a uniform surface is presented, with no "gaps" for legs or arms to slide under and catch on things like the hook end of a spring. As shown in FIG. 8, a lower surface of the foam pad 31 is fitted with the connector 30, which fits into the slot on rail 27 to connect the foam pad to the trampoline.

Alternatively, the accessory could for example be an item such as the wall of a safety enclosure or similar. The enclosure wall shown in FIG. 7B could be fitted with a connector 30 on or close to its lower edge, so that it can be fitted to the trampoline. The connector 30 is attached to or forms part of the lower edge of the wall of the enclosure, and as shown in FIG. 7B slots into the rail 27 so that the base or lower edge of the side wall is connected to the edge of the trampoline mat.

Other auxiliary accessories can be fitted with the connector 30 for use as required. For example, a protective or weather cover could be fitted with the connector 30 so that the trampoline can be easily covered when not in use. A ladder, slide or similar can be fitted with the connector 30 to allow it to be easily fitted to the trampoline.

As described above, the first two preferred embodiments of the rail have both ends open. One or both of these could be closed rather than open. Also, the hollow area does not have to run the full length of the rail. If required for structural reinforcement or similar, the rail could be wholly or partly 'filled' or solid along at least part of the length of the rail.

Further forms or variants of accessory attachment system suitable for use with the trampoline 1 will now be described with reference to FIG. 8 and also FIGS. 13B and 14B.

Figure 13A:
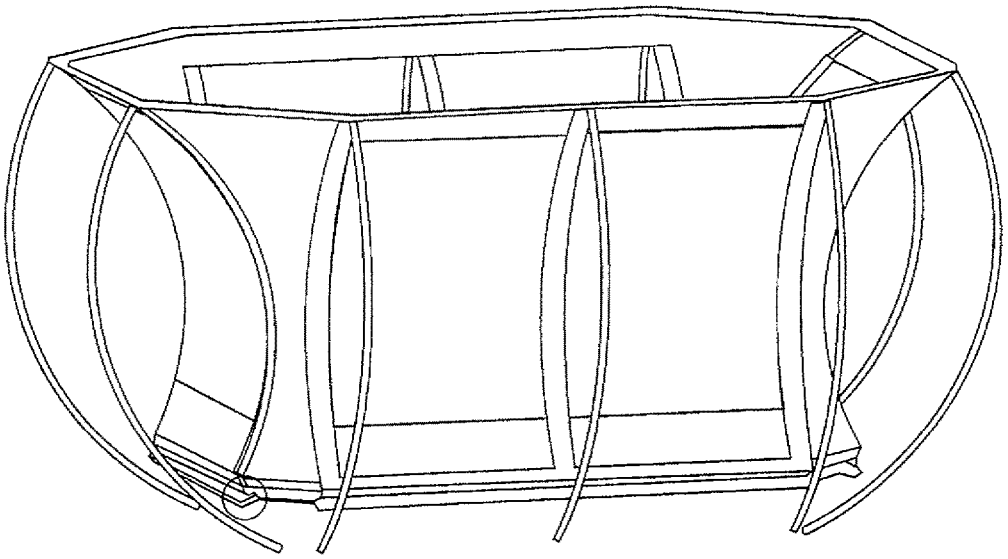
FIGS. 13A and 13B shows a similar enclosure to that of FIG. 12.
Figure 13B:
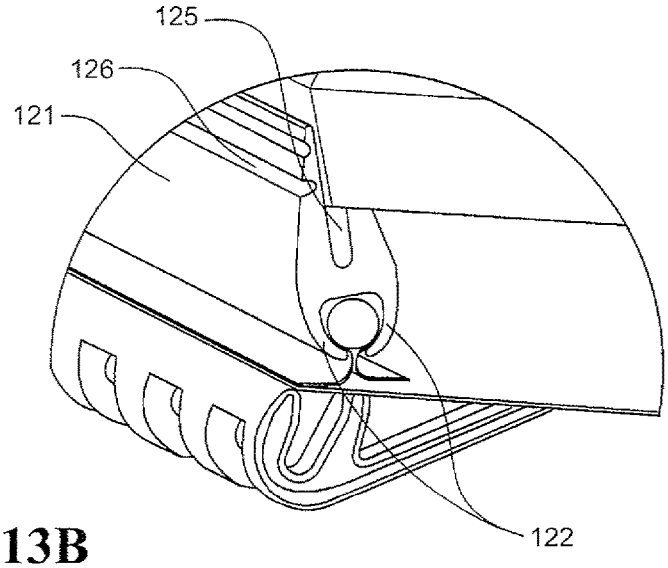

The accessory attachment rail 121 shown in FIG. 13B is similar to the rails shown in FIG. 8. However, the side wall portions 122 extend downwards, and the base portion 123 upwards. In use, the base portion 123 is connected to the enclosure or other accessory, and a corresponding mat connector 124 is attached to the trampoline mat (although as outlined for the connector 117 of the first two embodiments above, it may also be connected to the frame, or close to the centre of the mat, or in any other suitable and desirable location. The main body of the connector 124 is the same as in the preferred form, and the same as for the connector 117 of the first two preferred embodiments described above: circular in cross-section. The main body of the connector 124 is in use located between the side wall portions 122, which curve or angle towards one another over the body of the connector 124 to hold it in position. A portion of the connector 124 extends away from the main body, through the slot, to e.g. the mat to attach to the mat. The connector 124 is formed by folding a piece of webbing in half and sewing along its length to create a pocket which is filled with a plastic tube, a length of rope/cord, or a fibreglass rod. This piece of webbing is then sewn to the mat surface.

The bottom edge of the enclosure can be formed in a similar way: a section of the enclosure fabric can be folded over and sewn to form a cavity that in use holds a tube. Alternatively, the edge of the fabric can be rolled into a tube. The edge is then sewn through to form a more solid edge. Another alternative would be to knit the tubular form as part of the edge.

The walls of the accessory attachment rail 121 are, in the embodiment shown, continuous. However, they could be discontinuous, in a similar fashion to the rail embodiment shown in FIG. 8.

The upwards-facing base portion 123 includes a slot or groove 125 running substantially the full length of the attachment rail 121, aligned running parallel to the groove formed by the two side wall portions 122, with an upward-facing opening. In use, a lower edge of the enclosure or other accessory is located into the upper groove 125. In the most preferred embodiment, each of the side walls of the base portion each side of the slot include at least one cut-out trench each side, aligned running substantially horizontally, substantially the length of the side wall, so that the trench 126 on the outer side faces outwards and the trench on the inner side (not shown) faces inwards. The trenches are located substantially at the same position or height on the inner and outer side walls. The trenches are formed so that the thickness of the wall between the trenches and the groove 125 is thin enough to be sewn through by a sewing machine needle or similar. In this fashion, the lower edge of the enclosure or accessory can be attached by sewing to the attachment rail 121.

It should be noted that although sewing is the most preferred way of attaching the enclosure or accessory to the rail 121, other ways are also envisaged, such as gluing, plastic welding, riveting, etc. It should also be noted that the rail could be arranged to face the other way up, with the base downwards and sewn to e.g. the mat, frame, etc.

Figure 14A:
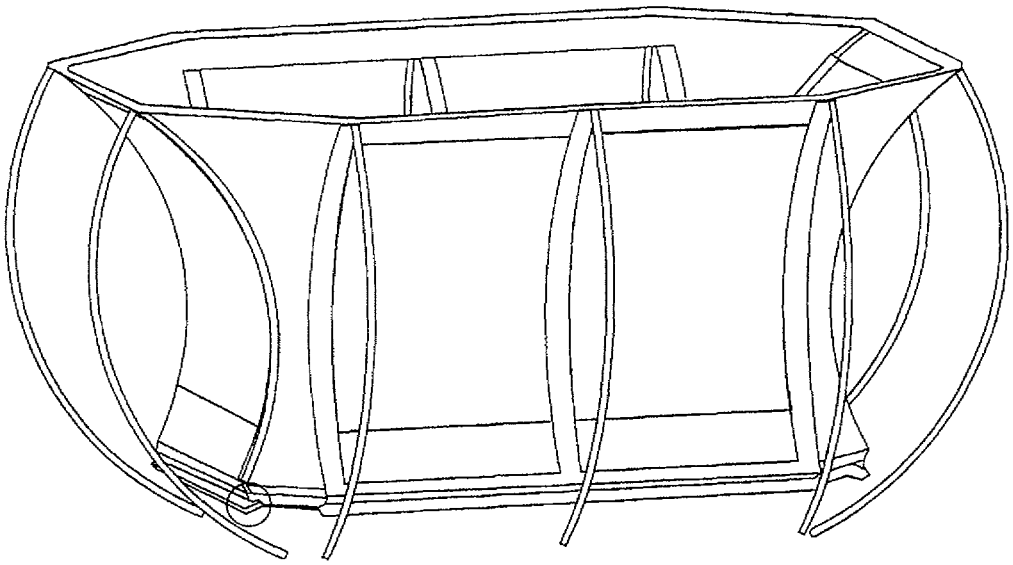
FIGS. 14A and 14B shows a similar enclosure to that of FIG. 12.
Figure 14B:
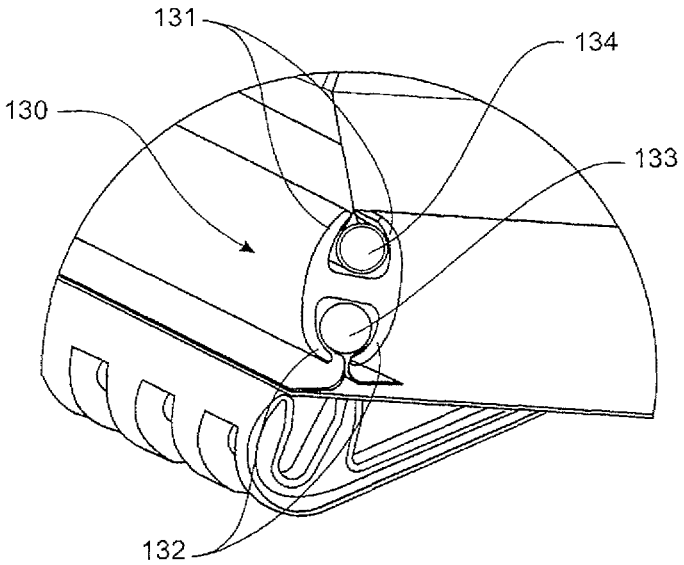

The fourth form of accessory attachment rail 130 shown in FIG. 14B has a double pair of side walls, one pair 131 facing upwards in use, and the second pair 132 facing downwards, from a central base portion. In cross-sectional profile, the accessory attachment rail 130 has the overall appearance of a capital 'H', with the ends of each one of the four uprights curved or angled inwards towards the other one of the pair, and the central base portion forming the 'horizontal' or cross-piece of the 'H'. The walls are continuous in the preferred form, by may be discontinuous if required, on one or both sides.

In use, a mat connector 133 is attached to e.g. the mat of the trampoline, facing upwards, and a second accessory or enclosure connector 134 is connected to the lower edge of the enclosure or accessory, facing downwards. Each of the connectors 133 and 134 in the preferred embodiments are circular in cross-section. The connectors are pushed between the pairs of side walls on the upper and lower side respectively, and the side walls arc or curve around the circular bodies to hold the connectors in position. In this fashion, the accessory attachment rail 30 is attached to the mat, and the enclosure or accessory is attached to the attachment rail 30, thus holding the enclosure or accessory in position relative to the mat.

As outlined above, the attachment rail 130 could be connected to an item other than the mat if required, such as the frame or similar. The connectors 133 and 134 can be formed in the same or similar manner to that outlined above.

Safety Enclosure

A preferred form of safety enclosure for use with the preferred form of trampoline system 1 will now be described with reference to FIG. 12.

Figure 12:
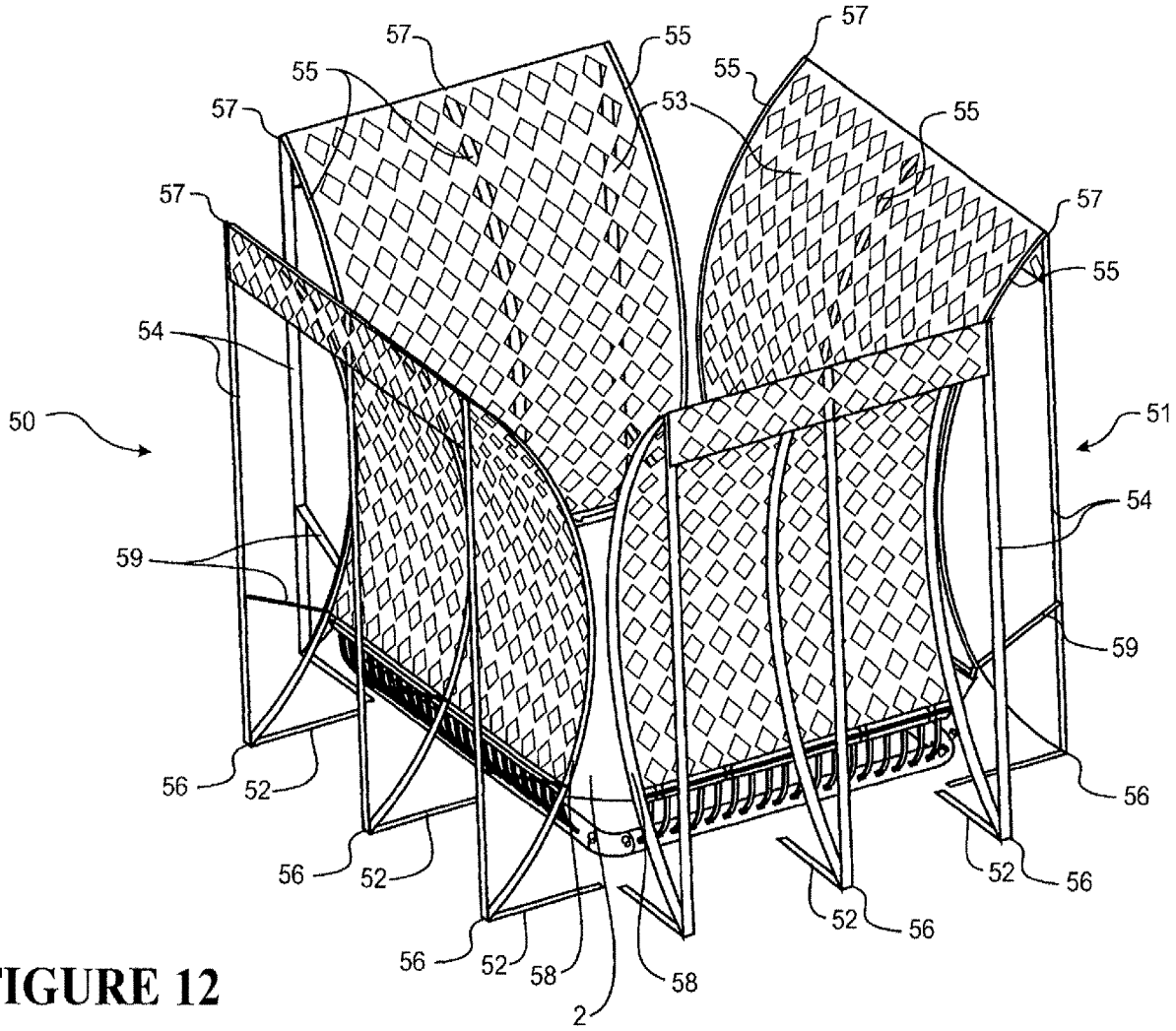
FIG. 12 shows a preferred from of enclosure for use with the trampoline of the first preferred form.

The safety enclosure is generally designated as safety enclosure 50 in FIG. 12. The preferred form of trampoline system 1 is rectangular (i.e. with four sides) as described above, and the safety enclosure described below is for use with that preferred rectangular form. However, the safety enclosure could be adapted for use with a circular, oval, triangular, hexagonal or any other outline shape of trampoline system.

The preferred form of safety enclosure 50 has four separate main components or side assemblies 51, each side assembly 51 corresponding to a side of the trampoline enclosure. Each of the side assemblies 51 is substantially identical to the others (with minor differences with regard to length, etc, if the sides of the trampoline have sides of different lengths, for example if the trampoline is rectangular rather than square). Each side assembly has an enclosure net 53, and at least two and preferably three or more upright net support arrangements or assemblies, each net support assembly formed from an outer upright 54, an inner upright 55, and a base unit 52. The body of each of the outer uprights 54 is preferably aligned substantially vertically. Each of the outer uprights 54 is connected to a base unit 52 at its lower end 56. The outer uprights 54 are, in the preferred embodiment, formed from pultruded fibreglass and have the form of a flat elongate bar, with a generally rectangular cross-section. The larger flat faces or sides of the flat elongate bars are aligned facing inwards and outwards, parallel to the edge of the mat 2.

The preferred embodiment of the base units 52 is that of a flat elongate bar, with the same cross-sectional profile as the outer uprights 54. The base units 52 are connected one each to each of the lower ends 56 of the outer uprights 54, and aligned perpendicular to the outer uprights 54 to extend inwards towards the mat 2 from the lower ends 56. The base units 52 have the same cross sectional profile as the outer uprights 54. The outer surfaces of the base units 52 lies flat against the floor or surface on which the trampoline system 1 rests. The base units 52 are not mandatory: the lower end of the outer uprights 54 could be adapted to rest on the floor, for example, or the safety enclosure 50 could be connected to the trampoline system 1 in such a manner that the safety enclosure 50 does not contact the floor.

The inner uprights 55 also preferably have the same cross-sectional profile and size as the outer uprights 54 and the base units 52. The inner uprights 55 are connected to the outer uprights 54 at the upper ends 57 and at the lower ends 56, on the inner faces of the outer uprights 54. The inner uprights are longer than the outer uprights 54, and so each of the inner uprights is bowed or curved inwards towards the mat 2. The connection location as just described is at the ends of the outer uprights, but could be at any suitable location along their length. It is not strictly necessary for a physical connection to be made at the upper ends: the upper end of the inner upright 52 could rest against the inner face of the outer upright without being connected. The same effect could also be achieved by 'recurving' the inner upright at one or both ends (i.e. curving one or both of the ends back on themselves), so that the points of contact with the outer upright are not directly at the ends of the inner upright, but are close to the ends. If it would be appropriate to do so, 'end' should be taken to mean either the connection point, or the actual end.

As described above, the outer upright and base unit are connected in such a way that each one of the base units 52 has an outer upright 54 extending substantially vertically upwards from the outer end of the base unit 52. Preferably the inner upright 55 is connected so that it extends upwards from substantially the same point, bending or bowing towards and then away from the mat 2 to connect with the outer upright 54 at the upper end 57.

In the preferred embodiment, three of these net support arrangements (base unit 52, outer upright 54 and inner upright 55) are located on each side or edge of the mat 2, with two at or close to each end, and the third located equidistant from the end two. However, two, four, five or more of these arrangements could be used as required, depending on the size of the mat 2. If using a circular or oval mat, then a number could be located around the circumference at suitable intervals. If using a trampoline with a different number of sides, the appropriate number can be connected at the appropriate points to provide the necessary coverage.

The enclosure net 53 is formed from a suitable material, such as nylon webbing. The net 53 has a generally rectangular form, and is fitted or formed with vertically-oriented sleeves 58, open at their lower ends. The location of the sleeves 58 coincides with the location of the inner uprights 55. Two of the sleeves are located at each vertical edge of the net 52. In the preferred embodiment, the net has one remaining sleeve (three in total), the remaining sleeve located vertically bisecting the net 53. The open ends of the sleeves 58 are in use slipped over the inner uprights 55 so that the net 53 forms an inwardly-bowed vertically aligned barrier along the edge of the mat 2, the open ends preferably coinciding with the edge of the mat 2. The lower edge of the net 53 is also aligned with, and co-located with, the edge of the mat 2, and is connected to the edge of the mat 2 in a manner that will be described below. The uppermost portion of the net 53 extends slightly beyond the upper end 57, and is folded over and down so that it aligns with the outer faces of the outer uprights 54. If the inner and outer uprights are connected at their upper ends, then it is preferred that the net is placed in position before this connection takes place, with the net formed suitably (e.g. with an aperture or similar) to allow the connection to take place. Alternatively, the connection of the inner and outer uprights could be made via the (intervening) net.

The net 52 is fitted with a connector on or close to the lower edge, such as the connector 30 described above. The edge of the mat 2 is fitted with the corresponding rail 27. The connector 30 fits to the rail 27 to hold the lower edge of the net 52 against the edge of the mat 2. It is most preferred that each of the inner uprights 55 is also fitted with a connector (not shown) suitable for slotting into the rail 27 to hold the inner uprights in position relative to the mat 2.

In use, a user may fall against the net 52 either where it covers one of the inner uprights 55, or where it is freely supported. In each case, the inner uprights 55 and the outer uprights 54 will bend outwards, or bow towards the outer upright, or both, to absorb the impact force. In particular, when an inner upright is impacted directly, the inner upright will bow outwardly (towards the outer upright) at the point of impact, as well as flex at its lower end, to absorb the impact.

As further shown in FIG. 12, the safety enclosure 50 can be fitted with a brace 59, which in the preferred embodiment is a fibreglass bar having the same cross-sectional profile as the base 52 and the inner and outer uprights 55, 54. The inner end of the brace 59 is connected to the outer surface of the inner upright 55 at or just above the point where the inner upright 54 meets the mat 2. The body of the brace 59 is straight, and angled upwards to connect with the inner face of the outer upright 54. It is preferred that the brace is used on all of the net support arrangements. However, it could be used on one, some or all of the net support arrangements and left off the others, as required.

As shown in FIG. 12, the corners of the safety enclosure 50, between the ends of each of the side assemblies 51, are open. These openings can be used to access the jumping surface of the mat 2, and can be closed by flaps of netting or similar (not shown) in use, to prevent a user inadvertently exiting the enclosed area.

FIGS. 13A and 14A show similar forms of safety enclosure on a trampoline of the invention.

The foregoing description of the invention includes preferred forms thereof. Modifications may be made thereto without departing from the scope of the invention as defined in the accompanying claims.

The invention claimed is:

1. A trampoline comprising:

a flexible rebounding mat, a continuous frame below a periphery of the flexible rebounding mat when the trampoline is positioned with the mat uppermost, a plurality of resiliently flexible support rods having an approximately rectangular cross-section transverse to a length of the rods and connecting between the frame and the mat, upper ends of the support rods connecting to the mat around the periphery of the mat and lower ends of the support rods connecting to the frame below the mat, the free length of the support rods between the upper ends and the lower ends support rods bowing outwards and curving upwards from the frame towards the mat substantially perpendicular to the frame, to hold the mat in tension above the frame.

2. A trampoline as claimed in claim 1 wherein the support rods comprise main support rods having secondary support rods located at the rear of the main support rods and extending along part of the rear of the main support rods, the length of the secondary support rods being approximately half to two-thirds that of the main support rods, the lower ends of both the main support rods and the secondary support rods co-located.

3. A trampoline as claimed in claim 2 wherein the secondary support rods have a cross-sectional profile the same shape and size as that of the main support rod.

4. A trampoline as claimed in claim 2 wherein an upper end of each secondary support rod is connected to an adjacent portion of one of the main support rods.

5. A trampoline as claimed in claim 2 wherein the upper ends of the support rods are fitted with edge connectors connecting the upper ends of the support rods to the trampoline mat.

6. A trampoline as claimed in claim 2 wherein the mat is fitted with mat edge fittings connecting the upper ends of the support rods to the mat.

7. A trampoline as claimed in claim 1 wherein the upper ends of the support rods are fitted with edge connectors connecting the upper ends of the main support rods to the mat.

8. A trampoline as claimed in claim 1 wherein the mat is fitted with mat edge fittings connecting the upper ends of the support rods to the mat.

9. A trampoline as claimed in claim 8 wherein groups of mat fittings are ganged as unitary items by each of which the upper ends of groups of support rods are connected to the mat.

10. A trampoline as claimed in claim 1 also having an edge accessory attachment rail connected to the trampoline and comprising a longitudinally extending hollow central area and a longitudinally extending slot from inside the hollow central area to outside the edge accessory attachment rail.

11. A trampoline according to claim 10 also comprising a safety enclosure having a connector along a lower edge of the safety enclosure, the connector locating in the hollow central area of the edge accessory attachment rail to connect the lower edge of the safety enclosure to the trampoline.

12. A trampoline according to claim 10 also comprising an edge protector pad shaped and sized to cover an edge of the mat, a lower surface of the edge protector pad comprising therealong a connector locating in the hollow central area of the edge accessory attachment rail to connect the edge protector pad to the trampoline.

13. A trampoline as claimed in claim 1 comprising a safety enclosure net and enclosure support members supporting the safety enclosure net above and around the mat.

14. A trampoline as claimed in claim 1 comprising a safety enclosure having a lower edge connected to the edge of the trampoline mat, and upright enclosure support members having lower ends connected to the frame below the mat and not otherwise being supported by to the trampoline, and upper ends connected to the top of the enclosure to support the enclosure above the mat.

15. A trampoline as claimed in claim 1 wherein the mat is larger than the frame so that the periphery of the mat overlaps the frame.

16. A trampoline as claimed in claim 1 wherein the trampoline has an at least approximately oval or circular shape.

17. A trampoline comprising:

a flexible rebounding mat, a continuous frame below a periphery of the flexible rebounding mat when the trampoline is positioned with the mat uppermost, and a plurality of resiliently flexible support bars connecting between the frame and an edge of the mat to hold the mat in tension, the support bars comprising a resiliently flexible main support bar substantially perpendicular to the frame and having a lower end connected to the frame below the mat and an upper end connected to the periphery of the mat, and comprising a resiliently flexible secondary support bar on a side of the main support bar, the secondary support bar extending from the frame towards the mat along part of the length of the main support bar and increasing the resistance of the support bar to bending along said part of the length of the main support bar.

18. A trampoline as claimed in claim 17 wherein the upper ends of the main support bars are fitted with edge connectors connecting the upper ends of the main support bars to the mat.

19. A trampoline as claimed in claim 17 wherein the length of the secondary support bar is approximately half to two-thirds that of the length of the main support bar.

20. A trampoline system as claimed in claim 17 wherein the secondary support bar has a cross-sectional profile the same shape and size as that of the main support bar.

21. A trampoline as claimed in claim 17 wherein the secondary support bar at or towards a mat end thereof is connected to the main support bar.

22. A trampoline as claimed in claim 17 wherein the mat is fitted with mat edge fittings connecting the upper ends of the support bars to the mat.

23. A trampoline as claimed in claim 17 wherein the mat is larger than the frame so that the periphery of the mat overlaps the frame.

24. A trampoline as claimed in claim 17 wherein the trampoline has an at least approximately oval or circular shape.

25. A trampoline and safety enclosure, the trampoline comprising:

a flexible rebounding mat, a continuous frame below a periphery of the flexible rebounding mat when the trampoline is positioned with the mat uppermost, and a plurality of resiliently flexible support rods having an approximately rectangular cross-section transverse to a length of the rods and connecting between the frame and the mat, upper ends of the support rods connecting to the mat around the periphery of the mat and lower ends of the support rods connecting to the frame below the mat, the free length of the support rods between the upper ends and lower ends bowing outwards and curving upwards from the frame towards the mat substantially perpendicular to the frame to hold the mat in tension above the frame, the safety enclosure connected to the trampoline and comprising enclosure support members connected to the frame of the trampoline below the mat and not otherwise being supported by or to the trampoline, and supporting the enclosure around and above the mat of the trampoline.

26. A trampoline and safety enclosure as claimed in claim 25 wherein the support rods are substantially flat when no external force is applied.

27. A trampoline and safety enclosure as claimed in claim 25 wherein the mat is larger than the frame so that the periphery of the mat overlaps the frame.

28. A trampoline and safety enclosure as claimed in claim 25 wherein the support rods comprise main support rods having a lower end connected to the frame, an upper end connected to an edge of the mat, and a free length extending upwardly from the frame to the edge of the mat and bowed towards the mat, and secondary support rods on one side of the main support rods, the secondary support rods extending from the frame towards the mat along part of the length of the main support rods and increasing the resistance of the support rods to bending along said part of the length of the main support rods.

29. A trampoline and safety enclosure as claimed in claim 25 wherein the trampoline has an at least approximately oval or circular shape.

* * * * *